US010779587B2

(12) United States Patent
Maud

(10) Patent No.: US 10,779,587 B2
(45) Date of Patent: Sep. 22, 2020

(54) HEAT INSULATION STRUCTURE

(71) Applicant: adidas AG, Herzogenaurach (DE)

(72) Inventor: Tim Maud, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 698 days.

(21) Appl. No.: 14/598,853

(22) Filed: Jan. 16, 2015

(65) Prior Publication Data

US 2015/0201683 A1 Jul. 23, 2015

(30) Foreign Application Priority Data

Jan. 17, 2014 (DE) ..... 10 2014 200 824

(51) Int. Cl.
*A41D 13/002* (2006.01)
*A41D 31/02* (2019.01)

(52) U.S. Cl.
CPC ..... *A41D 13/002* (2013.01); *A41D 31/02* (2013.01); *A41D 2400/10* (2013.01); *Y10T 428/234* (2015.01)

(58) Field of Classification Search
CPC .. A41D 13/002; A41D 31/02; A41D 2400/10; Y10T 428/234
See application file for complete search history.

(56) References Cited

U.S. PATENT DOCUMENTS 1,569,955 A * 1/1926 Falter ..... A47G 9/00 112/420
2,464,380 A * 3/1949 Daiber ..... A41D 27/06 2/458
2,960,702 A 11/1960 Linke et al.
3,839,756 A * 10/1974 Hibbert ..... A47G 9/086 5/413 R
4,575,876 A * 3/1986 Weaver ..... A47G 9/086 2/69.5
5,408,700 A 4/1995 Reuben et al.
5,692,245 A * 12/1997 Reuben ..... A41D 27/02 112/420

(Continued)

FOREIGN PATENT DOCUMENTS

CH 343086 12/1959
EP 0078691 A1 * 5/1983 ..... A41D 31/02

(Continued)

OTHER PUBLICATIONS

Japanese Application No. 2015-005577, Office Action dated Jan. 31, 2017 (5 pages for the English translation and 3 pages for the original document).

(Continued)

*Primary Examiner* — Michael Zhang
(74) *Attorney, Agent, or Firm* — Kilpatrick Townsend & Stockton LLP

(57) ABSTRACT

Described are heat insulation structures for a garment. The heat insulation structure includes at least one first insulation element having a first uncompressed shape, at least one second insulation element having a second uncompressed shape that is different than the first uncompressed shape, and a contact area formed when the first uncompressed shape contacts the second uncompressed shape. The second uncompressed shape is deformable through pressure applied by a wearer's body when the garment is worn, which increases a size of the contact area.

21 Claims, 13 Drawing Sheets

(56) References Cited

U.S. PATENT DOCUMENTS

| | | | | |
|---|---|---|---|---|
| 5,713,079 | A | 2/1998 | Simon et al. | |
| 8,578,516 | B2 | 11/2013 | Li | |
| 2005/0210586 | A1* | 9/2005 | Pedersen | A47G 9/0207 5/502 |
| 2006/0195964 | A1* | 9/2006 | Bury | A41D 3/00 2/108 |
| 2009/0100568 | A1* | 4/2009 | Judd | A61H 7/001 2/95 |
| 2013/0177731 | A1 | 7/2013 | Moriarty | |
| 2013/0276201 | A1* | 10/2013 | Pezzimenti | A41D 27/245 2/69 |
| 2014/0099468 | A1* | 4/2014 | Cai | A47G 9/0207 428/74 |
| 2014/0250575 | A1* | 9/2014 | Man | A41D 31/02 2/456 |
| 2014/0250596 | A1* | 9/2014 | De La Place | A47G 9/0207 5/502 |

FOREIGN PATENT DOCUMENTS

| | | |
|---|---|---|
| EP | 947153 | 10/1999 |
| FR | 500136 | 3/1920 |
| GB | 2159050 | 11/1985 |
| JP | 59091318 | 5/1984 |
| JP | 2010018900 | 1/2010 |
| JP | 2011202295 | 10/2011 |
| WO | 9118542 | 12/1991 |
| WO | 9811795 | 3/1998 |

OTHER PUBLICATIONS

German Patent Application No. 102014200824.7, First Office Action dated Dec. 4, 2014, 9 pages (No English translation available. A summary of the Office Action is provided in the Transmittal Letter submitted herewith).

European Patent Application No. 15151089.8, Extended European Search Report dated Jun. 3, 2015, 6 pages.

European Application No. 17161069.4, Extended European Search Report dated Jun. 26, 2017, 8 pages.

German Patent Application No. DE 102014200824.7, Office Action dated Sep. 30, 2019, 10 pages (6 pages of English translation and 4 pages of Original document).

* cited by examiner

HEAT INSULATION STRUCTURE

CROSS REFERENCE TO RELATED APPLICATION

This application is related to and claims priority benefits from German Patent Application No. DE 10 2014 200 824.7, filed on Jan. 17, 2014, entitled HEAT INSULATION STRUCTURE FOR A GARMENT ("the '824 application"). The '824 application is hereby incorporated herein in its entirety by this reference.

FIELD OF THE INVENTION

The present invention relates to a heat insulation structure, particularly for outdoor garments.

BACKGROUND

It is a main object of garments, particularly in the outdoor sector, to thermally insulate the body of the wearer of such a garment from the environment and to minimize heat loss. For this purpose, a setup is typically chosen in which a material with good heat-insulating capabilities is placed between an outer layer and an inner layer, which provides an insulating effect. Both natural insulating materials, particularly down, and synthetic materials may be used in this regard.

To avoid unintended shifting or re-distribution of the insulating material, the insulating material is distributed using conventional structures, such as individual chambers or sections described in publications such as U.S. Pat. Nos. 2,464,380A, 5,408,700A, 8,578,516B2, and WO 98/11795 A1.

For example, certain chamber structures (hereinafter referred to as "H-structure" for short, due to the shape of the chambers), as illustrated in FIG. 1*a*, include partitions limiting the individual chambers, which are sewn in between the outer and the inner layers. A variation of this construction is a trapezoid setup, as shown in FIG. 1*b*. The benefits of such a H-shaped or trapezoid setup is that a consistent thickness of the insulating material may be provided across larger areas of the garment, which may provide effective heat insulation. However, these structures require considerable manufacturing effort.

In other examples of chamber construction, as illustrated in FIG. 1*c*, the outer and the inner layers of the garment are directly sewn or stitched together, thus creating individual chambers filled with insulating material. This structure can be manufactured with considerably less manufacturing effort than the H-structure described above. A disadvantage of such a design is that the seam construction depicted in FIG. 1*c* may allow heat to escape across the seam, or alternately allow ingress of cold air into the garment. Further, it is also a disadvantage of this construction that no insulating material is present in the area of the seams, where the outer layer and the inner layer are in direct contact. Thus, considerable heat loss occurs in the area of the seams, as can be seen in the thermal image of a conventional outdoor jacket of this construction in FIG. 1*d*.

To address this problem, U.S. Pat. No. 2,960,702A, for example, suggests placing two or more layers manufactured in this manner over each other with staggered seams, thus reducing the heat loss at the respective seams. This concept, in turn, increases the manufacturing effort and may also result in an undesired increase of the thickness of the garment. Another construction comprising a further outer layer that may be water-repellent is described in U.S. Publication No. 2013/0177731A1, which also involves an increased manufacturing effort and material input.

Finally, a bedspread is described in GB 2 159 050 A, which offers increased or reduced heat insulation, depending on which side of the bedspread lies at the bottom. However, such a design requires the chambers to be aligned in the longitudinal direction of the body.

It is therefore an object of the present invention to provide a heat insulation structure that is simple to manufacture and minimizes or reduces heat loss in the area of potential seams.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a heat insulation structure for a garment comprises at least one first insulation element comprising a first uncompressed shape, at least one second insulation element comprising a second uncompressed shape that is different than the first uncompressed shape, and a contact area formed when the first uncompressed shape contacts the second uncompressed shape, wherein the second uncompressed shape is deformable through pressure applied by a wearer's body when the garment is worn, which increases a size of the contact area.

In some embodiments, the at least one first insulation element and the at least one second insulation element are three-dimensional enclosed structures filled with insulating material. The at least one first insulation element may be connected to the at least one second insulation element at a respective seam, and the increased contact area is proximate to the seam such that the at least one second insulation element substantially overlaps the seam when it is deformed. The increased contact area may reduce body heat loss.

In some embodiments, in a cross-section of the heat insulation structure, the at least one second insulation element comprises a first arc along an inner surface of the at least one second insulation element, the first arc comprising a first length, and a second arc along an outer surface of the at least one second insulation element, the second arc comprising a second length, wherein the first length is longer than the second length. A ratio of the first length to the second length may range between 1.2:1-3:1. A ratio of the first length to a height of the at least one second insulation element in the cross-section may range between 1.2:1-3:1.

According to some embodiments, at least one of (i) the at least one first insulation element and (ii) the at least one second insulation element comprise a filling material. A ratio of a weight of the filling material in the at least one second insulation element to a weight of the filling material in the at least one first insulation element may range between 1.3:1-4:1.

In some embodiments, at least one of the at least one first insulation element and the at least one second insulation element is elongated.

In certain embodiments, the at least one first insulation element and the at least one second insulation element may be arranged substantially horizontally when the garment is worn. In further embodiments, the at least one first insulation element and the at least one second insulation element may be arranged in a V-shape within the garment. In additional embodiments, at least one first insulation element and the at least one second insulation element may be alternatingly arranged alongside each other.

The heat insulation structure may further comprise at least one cover layer, which is arranged on an inside and/or an outside of the heat insulation structure.

In certain embodiments, a garment comprises the heat insulation structure.

According to certain embodiments of the present invention, a heat insulation structure for a garment comprises a plurality of first insulation elements, each first insulation element comprising a first uncompressed shape, a plurality of second insulation elements, each second insulation element comprising a second uncompressed shape that is different than the first uncompressed shape, and a plurality of contact areas formed when each of the first uncompressed shapes contacts each of the second uncompressed shapes, wherein each of the second uncompressed shapes are deformable through pressure applied by a wearer's body when the garment is worn, which increases a size of each of the contact areas.

According to certain embodiments of the present invention, a heat insulation structure for a garment comprises at least one first insulation element, at least one second insulation element, and a contact area formed when the at least one first insulation element contacts the at least one second insulation element, wherein the at least one first insulation element and the at least one second insulation element each comprise an inner layer and an outer layer defining a cavity, wherein a surface area of the inner layer of the at least one first insulation element is less than a surface area of the inner layer of the at least one second insulation element, and wherein the at least one second insulation element is deformable through pressure applied by a wearer's body when the garment is worn, which increases a size of the contact area.

In some embodiments, the surface area of the inner layer of the at least one first insulation element is substantially of equal size as a surface area of the outer layer of the at least one first insulation element. In further embodiments, the surface area of the inner layer of the at least one second insulation element is larger than a surface area of the outer layer of the at least one second insulation element. In other embodiments, the inner layer of the at least one first insulation element and the inner layer of the at least one second insulation element are jointly provided as an integral piece. In some embodiments, the outer layer of the at least one first insulation element and the outer layer of the at least one second insulation element are jointly provided as an integral piece.

BRIEF DESCRIPTION OF THE DRAWINGS

In the following detailed description, various embodiments of the present invention are described with reference to the following figures.

BRIEF DESCRIPTION

Figure 1A:
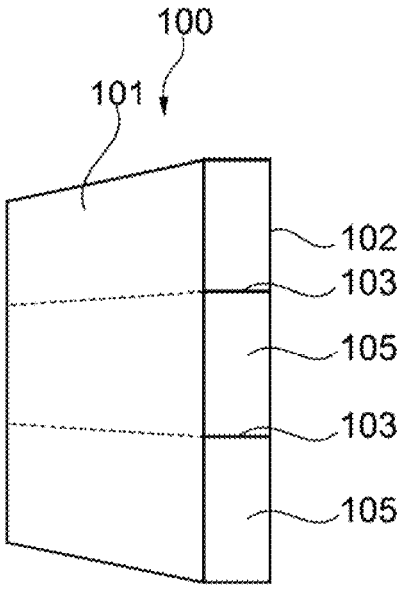
FIGS. 1*a*-1*d* illustrate conventional structures for heat insulation, as well as a thermal image of an outdoor jacket based on a known structure.

Certain embodiments of the present invention comprise a heat insulation structure for a garment, in particular an outdoor garment. The heat insulation structure comprises a first insulation element and a second insulation element, wherein the second insulation element comprises a different initial shape than the first insulation element, wherein the first insulation element is connected to the second insulation element, and wherein the second insulation element is deformed when wearing the garment by a pressure on an inside of the heat insulation structure such that a contact area, in which the first insulation element contacts the second insulation element is increased.

In certain embodiments, the initial shape refers to a shape of the first and second insulation elements when no pressure is exerted on the inside of the heat insulation structure. Moreover, the shape may refer to a cross-sectional shape of the first and second insulation elements. The term "different initial shape" may furthermore also take into consideration the orientation of the first and second insulation elements. That is, the first and second insulation elements may both have the same or a similar (cross-sectional) form, for example they may both have an oval form, but they may be oriented differently. For example, the first insulation element may have an oblate cross-section and the second insulation element may have a prolate cross-section. Such embodiments with a similar form but different orientations of the first and second insulation elements are also covered by the term "different initial shape."

In some embodiments, the heat insulation structure comprises a plurality of first insulation elements and a plurality of second insulation elements, wherein the second insulation elements each comprise a different initial shape than the first insulation elements, wherein each first insulation element is connected to at least one second insulation element, and wherein the second insulation elements are deformed when wearing the garment by a pressure on the inside of the heat insulation structure such that contact areas, in which the first insulation elements contact the second insulation elements, are increased.

In certain embodiments, when the garment is worn, the contact area is increased between each first insulation element and the respective second insulation element or elements it is connected to. It is, however, also possible that contact areas are only increased between some of the first and second insulation elements.

It is furthermore explicitly mentioned here that the heat insulation structure and/or the garment may also comprise further insulation elements or other elements, different than the first and second insulation elements.

The heat insulation structure, according to certain embodiments of the invention, combines simple manufacturing with good heat insulation properties. When the garment is worn, the second insulation elements are deformed such that they "nestle against" the respective first insulation elements, thus at least partially sealing off any possible seams or spaces through which heat might escape.

In certain embodiments, at least one first insulation element and at least one second insulation element are connected at a respective seam and the increased contact area is proximate to the seam such that the at least one second insulation element substantially overlaps the seam when the garment is worn.

In some embodiments, all first and second insulation elements are connected by respective seams and there are increased contact areas proximate to all such seams so that the second insulation elements substantially overlap all the seams when the garment is worn.

In general, when talking about "at least one first insulation element" and "at least one second insulation element" in this description, for the case of a plurality of first and second insulation elements, these terms may refer to all of the first and second insulation elements. These terms may, however, also refer only one or more, but not all, of the first and/or second insulation elements.

To create such a heat insulation structure according to the invention, layers of materials may be joined together such that cavities are formed between the layers as described in further detail below. Seams may be used to join the layers of fabric forming the garment. In some embodiments, seams may be designed such that movement of the insulating material in the garment is reduced and/or inhibited. A heat insulation structure may be constructed from two or more discrete insulation elements defined by layers of materials.

For example, the heat insulation structure may be constructed from first insulation elements positioned proximate second insulation elements, and these elements may be connected to each other by a seam. The second insulation element may be constructed so that, during use, the second insulation element substantially overlaps adjacent seams.

By overlapping the seams, the second insulation element provides insulation material in an area of the seam and thus, may reduce and/or inhibit heat loss at these points.

Further, in some embodiments, the second insulation element may be constructed such that, during use, the second insulation element covers at least a portion of the adjacent seam or seams.

The increased contact area in which at least one of the first insulation elements contacts at least one of the second insulation elements may reduce an escape of body heat. As already mentioned, in certain embodiments, there are increased contact areas between all first and second insulation elements when the garment is worn such that the loss in body heat is effectively reduced by the heat insulation structure.

As previously mentioned, the reduction in escaping body heat occurs by possible seams or spaces between the different elements of the heat insulation structure being, at least partially, "sealed off." Moreover, the increased contact area or areas may also serve the purpose of preventing humidity, such as fog or rain, from reaching the body of the wearer/user. This may further promote well-being and help prevent cooling.

In some embodiments, in a cross-section of the heat insulation structure, a first arc along an inner surface of at least one second insulation element comprises a greater length than a length of a second arc in the cross-section along an outer surface of the at least one second insulation element.

Herein, a ratio of the length of the first arc to the length of the second arc may lie in the range of 1.2:1-3:1, and may further lie in the range of 1.4:1-2:1, and may yet further lie in the range of 1.45:1-1.55:1.

Moreover, a ratio of the length of the above mentioned first arc to a height of the at least one second insulation element in the cross-section may lie in the range of 1.2:1-3:1, may further lie in the range of 1.3:1-2.5:1, and may yet further lie in the range of 1.4:1-2.1:1.

These ratios of the length of the first arc to the height may apply in combination with the above mentioned ratios of the length of the first arc to the length of the second arc. The ratios of the length of the first arc to the height may, however, also apply independently of the ratios of the length of the first and second arc, and vice versa.

Herein, the height of the second insulation element in the cross-section may, for example, refer to a height in the cross-section of the worn heat insulation structure/garment.

By providing the second insulation element in a manner that the length of an arc along the inner surface is greater than the length of an arc along the outer surface, in a cross-section of the heat insulation structure, the second insulation element "protrudes" from the inside of the heat insulation structure and is therefore compressed by the body of a wearer when the garment is worn, thereby leading to the "sealing off" effect discussed above. The above mentioned ratios of the inner and outer arc lengths and of the inner arc length and the height of the second insulation element have turned out to provide a good sealing of these areas of potential heat loss and thus a good reduction of body heat loss.

Once again, in case of a plurality of second insulation elements, these ratios may apply to all second insulation elements. In further embodiments, they may only apply to a subset of the second insulation elements.

In some embodiments, at least one first insulation element and/or at least one second insulation element comprise a filling material. In certain embodiments, all first and second insulation elements may comprise a filling material.

The filling material may considerably increase heat insulation of the heat insulation structure. Natural fibers or feathers, particularly down, or synthetic fibers may be used as the filling material in certain embodiments. In a dry state, down has very good heat insulating properties while having an extremely low weight. Synthetic fibers, in contrast to down, comprise good insulating properties even in a humid state. Air, gels, foam materials, liquids, gases or solids such as granules, may also be used as the filling material. Evacuated cavities, for reducing heat convection, may also be used.

Herein, a ratio of a weight of filling material in at least one second insulation element to a weight of filling material in at least one first insulation element may lie in the range of 1.3:1-4:1, may further lie in the range of 1.4:1-3:1, and may yet further lie in the range of 1.45:1-2:1.

The weight of filling material may be measured, for example, as the garment is constructed. The weight ratios may apply to a pair of a first insulation element and a second insulation element having substantially the same dimensions, e.g. a similar length (e.g. for elongated insulation elements) and height. The ratios may also apply to each pair of a first and second insulation elements. In certain embodiments, the ratios may apply to a subset of the first and second insulation elements.

These values have also turned out to provide "protruding" second insulation elements that provide the inventive "sealing off" effect when the garment is worn, as described above.

Moreover, alternatively and/or additionally to considering the ratio of the weight of the filling material in the at least one first insulation element to the weight of the filling material in the at least one second insulation element, a ratio of the volume of the filling material in the at least one first insulation element to a volume of the filling material in the at least one second insulation element may be considered. For this ratio of filling volumes, e.g. the ratios as mentioned above with respect to the filling weight, may apply.

The skilled person will understand that for a constant filling density with the same filling material in both the at least one first insulation element and the at least one second insulation element, there may be a direct one-to-one correspondence between volume and weight of the filling material, given e.g. by the density of the filling material. However, if e.g. different materials or different filling densities are used in the first and second insulation elements, respectively, there may be a more complicated relationship between filling volume and filling weight.

In certain embodiments, at least one first insulation element and at least one second insulation element each comprise an inner layer and an outer layer defining a cavity, wherein a surface area of the inner layer of the at least one first insulation element is less than a surface area of the inner layer of the at least one second insulation element.

This design may again help provide a shape of the second insulation elements compared to the shape of the first insulation elements that "protrudes" towards the body of a wearer, thus leading to the above described deformation of the second insulation elements and increased contact areas that seal off heat holes.

In certain embodiments, at least one first insulation element and at least one second insulation element each comprise an inner layer and an outer layer defining a cavity, wherein a surface area of the inner layer of the at least one first insulation element is substantially of equal size as a surface area of the outer layer of the at least one first insulation element, and wherein a surface area of the inner layer of the at least one second insulation element is larger than a surface area of the outer layer of the at least one second insulation element.

Due to the substantially similar surface areas of the outer and inner layers, the first insulation elements will form a cavity with an approximately symmetrical cross-sectional shape. Due to the greater surface area of the inner layer of the second insulation elements as compared to the surface area of the outer layer, the second insulation elements in contrast will form cavities with an asymmetrical shape comprising a greater thickness towards the inside, which results in the afore-described sealing of spaces or seams, etc. caused by the deformation occurring during use.

Herein, the inner layer of the at least one first insulation element and the inner layer of the at least one second insulation element may be jointly provided as an integral piece. Moreover, the outer layer of the at least one first insulation element and the outer layer of the at least one second insulation element may be jointly provided as an integral piece.

This design may avoid seams or the like in the inner layer or the outer layer, and may contribute to improved heat insulation and to avoiding the ingress of liquids, fog, dirt, etc. Such a configuration may also be formed using automated manufacturing, particularly if both the outer layer and the inner layer are provided as an integral piece. The inner layer and the outer layer may, for example, be rolled off respective rolls and sewn to each other so as to form the respective cavities. If the inner layer and the outer layer are fed to the sewing machine at the same speed between two neighboring seams that are being sewn, symmetrical insulation elements are created. If, in contrast, the inner layer is fed at a faster speed than the outer layer, a larger "pocket" automatically is formed, and it will therefore, e.g. after having been filled with a filling material, comprise a greater thickness in a direction perpendicular to the inside of the heat insulation structure.

For example, this configuration may also enable the first and second insulation elements to be manufactured by an efficient manner without modification and the need to be connected afterwards, for example by sewing or the like, which may result in a considerable reduction of the manufacturing effort. Further, the garment construction may be automated fully or in part.

In some embodiments, at least one first insulation element and/or at least one second insulation element are elongated.

Such elongated insulation elements are particularly easy to manufacture and may comprise a larger insulation volume compared to the surface of the insulation elements, which may minimize the amount of material needed. Elongated insulation elements are comfortable for the wearer/user, since they do not comprise any disturbing corners or edges and may lie flat on the body surface of a wearer without any pronounced bulges or points.

Generally, insulating elements may have cross-sections including but not limited to curved elements, such as circles, ovals, ellipses, or portions thereof, rectangles, triangles, irregular shapes, tubes, free-form geometries and/or combinations thereof.

In certain embodiments, at least one first insulation element and at least one second insulation element are arranged substantially horizontally when the garment is worn.

This orientation may, particularly in the case of garments, avoid the potential downward movement of filling material due to gravity, which could otherwise result in inconsistent distribution of the filling material within the insulation elements of the heat insulation structure and thus create insufficient insulation in the upper portions of the insulation elements.

In certain embodiments, at least one first insulation element and at least one second insulation element are arranged in the garment in a V-shape.

This arrangement may further improve a consistent distribution of filling material, for example, in the first and/or second insulation element(s), since such insulation elements arranged in a V-shape may also ensure a certain fixation in a direction perpendicular to the body axis. In this regard, the "V" may nonetheless be selected in a sufficiently horizontal manner for a negative influence of gravity, for example, to be largely avoided.

In some embodiments, at least one first insulation element and at least one second insulation element are alternatingly arranged alongside each other. In particular, all first insulation elements and second insulation elements may be alternatingly arranged alongside each other. However, it is once again emphasized that this may also be true for only a subset of the first and/or second insulation elements.

With this arrangement, the connecting area, e.g. the seam, may be sealed off towards each side of a first insulation element by the corresponding neighboring second insulation element(s), resulting in improved heat insulation. The symmetrical arrangement of first and second insulation elements may also be beneficial for wearing comfort, since no significant hollows or protrusions occur.

In certain embodiments, the heat insulation structure comprises at least one cover layer, which is arranged on the inside and/or an outside of the heat insulation structure. Such a cover layer may serve a range of further functions, such as increasing wearing comfort, for example by a fleece or wool layer or the like arranged on the inside. A cover layer arranged on the outside may, for example, prevent the ingress of water, dirt, fog or wind and further improve heat insulation. These are only some possibilities of how such a layer may be used. A person of ordinary skill in the relevant art may deduce further alternatives from their knowledge.

A garment including but not limited to an outdoor jacket, vest, insulated pants, hat, mittens, gloves, or the like with embodiments of a heat insulation structure according to the invention constitutes additional embodiments of the invention.

Due to the heat insulation structure according to the invention, such a garment is easy to manufacture but nonetheless provides excellent heat insulation without being overly detrimental to wearing comfort, volume, weight, or other relevant properties, particularly in the outdoor sector.

The invention also includes embodiments of heat insulation structures and garments in which several of the design features and options described herein are combined in order to utilize the heat insulation structures such that the requirements are met. In this regard, individual aspects may also be disregarded provided that they do not appear to be necessary for achieving a purpose at hand, with it not being a consequence of this that such embodiments cannot be considered as being part of the invention anymore.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIG. 1*a* shows an example 100 of a heat insulation structure built in "H-structure" known from the prior art. Partitions 103 are sewn in between two material layers 101 and 102. Herein, the cuboid cavities or chambers 105 formed by the two material layers 101 and 102, as well as the partitions 103, are usually filled with an insulating material such as down in order to increase the heat insulation of the heat insulation structure 100.

Figure 1B:
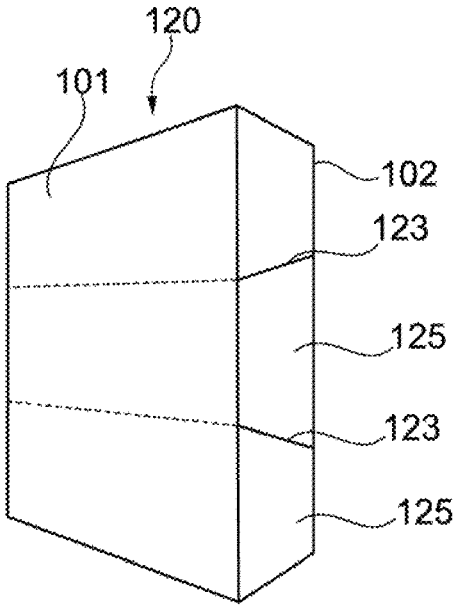

FIG. 1*b* shows an alternate construction 120 known from the prior art to the example 100 shown in FIG. 1*a*. The alternate construction 120 differs from the example 100 in that the partitions 123, in contrast to the partitions 103, are not mounted at a right angle to the material layers 101 and 102. Thus, cross-sections of the cavities 125 are trapezoidal or trapezoid-like.

Figure 1C:
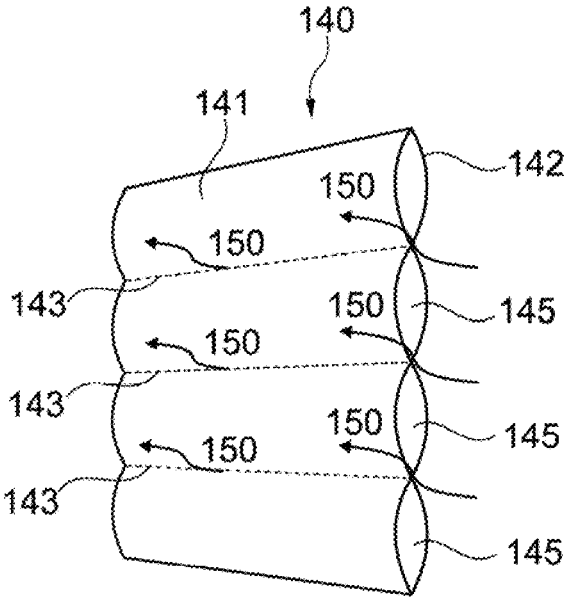

FIG. 1*c* shows a further example 140 of a heat insulation structure known from the prior art. Two material layers 141 and 142 are directly connected to each other by parallel seams 143 at certain distances. Thus, cavities or chambers 145 are formed, which are usually filled with an insulating material such as down. As is indicated by the arrows 150, areas of heat loss are located proximate the seams 143. This heat loss is due in part to the fact that little or no insulating material serving the purpose of heat insulation is present in these areas.

Figure 1D:
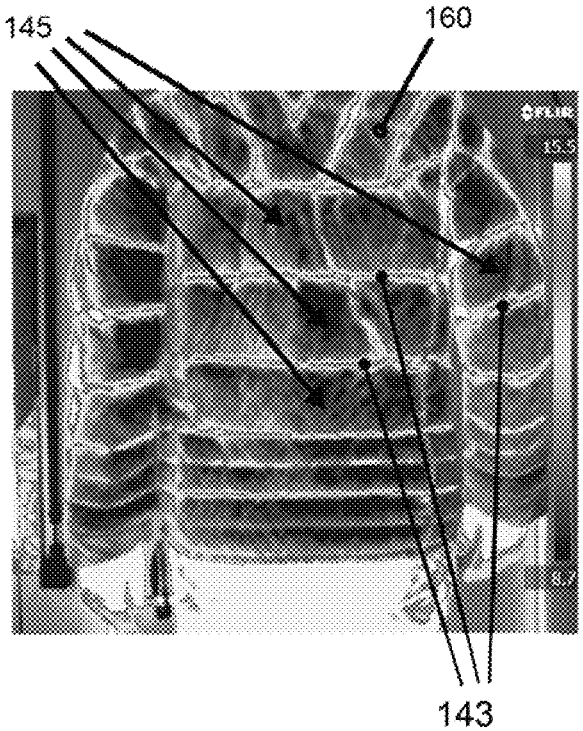

This is illustrated further by FIG. 1*d*, which shows a thermal image of a jacket 160 with a heat insulation structure constructed according to the principle shown in FIG. 1*c*. As can be seen in FIG. 1*d*, in the areas in which the chambers 145 filled with insulating material are located, the thermal image indicates low temperatures of up to approximately 10.5° C. In the areas of the seams 143, in contrast, the thermal image shows considerably higher temperatures of up to 15.5° C. This illustrates the heat loss of the structure shown in FIG. 1*c* in the area of the seams 143.

Figure 2A:
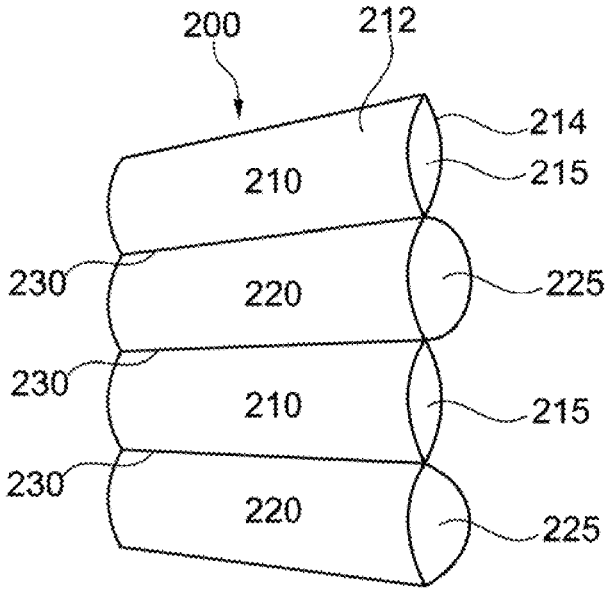
FIGS. 2*a*-2*c* are perspective views of a heat insulation structure with insulation elements, according to certain embodiments of the present invention.
Figure 2B:
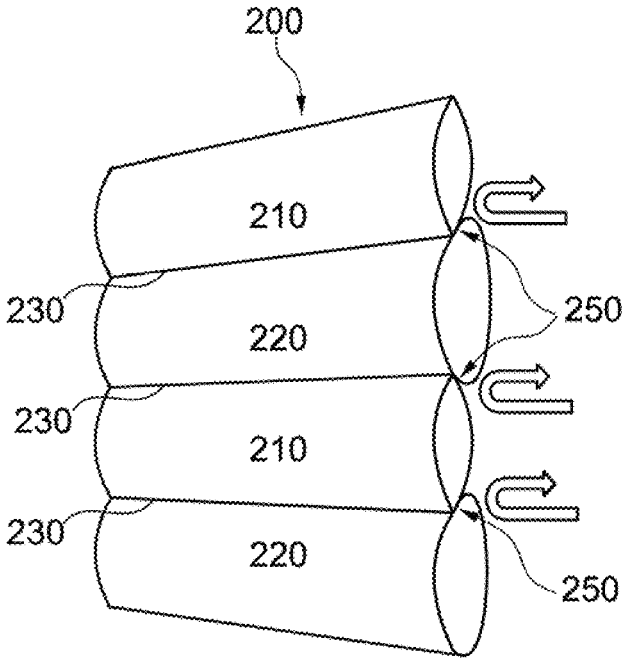
Figure 2C:
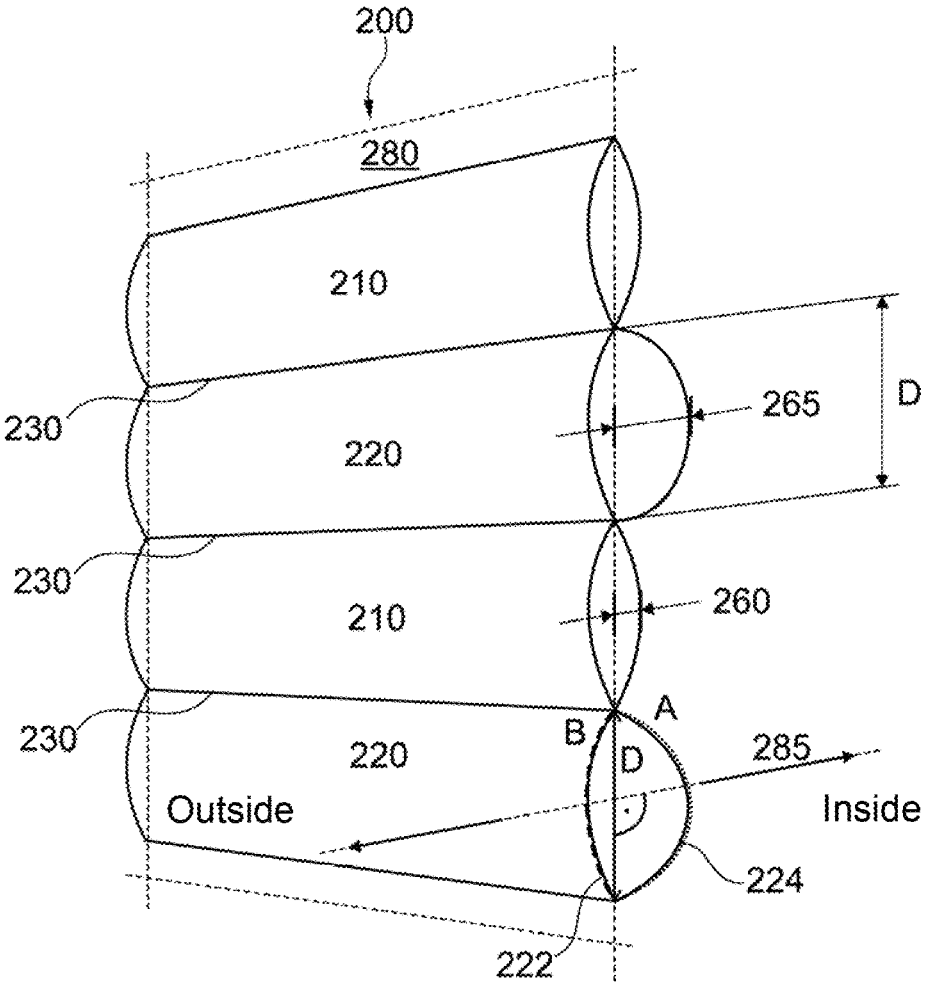

FIGS. 2*a*-2*c* illustrate embodiments of a heat insulation structure 200 according to the invention. The heat insulation structure 200 may, for example, be used in garments. The heat insulation structure 200 comprises a first insulation element 210 and a second insulation element 220. The second insulation element 220 comprises a different initial shape than the first insulation element 210 and the first insulation element 210 is connected to the second insulation element 220. When a garment with the heat insulation structure 200 is worn, the second insulation element 220 is deformed by a pressure on an inside of the heat insulation structure 200 such that a contact area 250, in which the first insulation element 210 contacts the second insulation element 220, is increased.

In certain embodiments, the heat insulation structure 200 comprises a plurality of first insulation elements 210 and a plurality of second insulation elements 220. The second insulation elements 220 each comprise a different initial shape than the first insulation elements 210. Each first insulation element 210 is connected to at least one second insulation element 220. When a garment with heat insulation structure 200 is worn, the second insulation elements 220 are deformed by a pressure on the inside of the heat insulation structure 200 such that contact areas 250, in which the first insulation elements 210 contact the second insulation elements 220 are increased. In certain embodiments, there are increased contact areas 250 between all insulation elements 210, 220 of the heat insulation structure 200 when pressure is exerted, such that connections 230, for example seams 230, are sealed off by the increased contact areas 250. It is also possible, however, that contact areas may only be increased between some of the first and second insulation elements 210, 220.

The increased contact areas 250, in which the first insulation elements 210 contact the second insulation elements 220, may, in particular, reduce body heat loss when a garment with heat insulation structure 200 is worn, cf. FIG. 2*b*.

The insulation elements 210, 220 may, for example, be formed from layers 212, 214 joined at seams 230 forming cavities 215, 225 therebetween.

The layers 212, 214 may be constructed from a single material or, in some embodiments, multiple materials. Materials useful for the construction of such layers 212, 214 include but are not limited to down-proof fabrics, such as micro lightweights, lightweight wovens, ultralight fabrics, lightweight fabrics, breathable fabrics, polyesters, such as woven polyester and brush polyester, nylon, canvas, cotton, wool, fleece, silk, flannel, closely knitted or woven fabrics or combinations thereof.

Further, layers 212, 214 may be treated with, for example, down proofing treatments, chemical treatments such as durable water repellant treatments, and the like.

In certain embodiments, the first and second insulation elements 210, 220 are connected to each other by a respective seam 230. For example, the increased contact areas 250, created by the pressure on the inside of the heat insulation structure 200 when wearing a garment therewith, may be proximate to the seams 230 such that the second insulation elements 220 substantially overlap or cover the seams 230, as shown in FIG. 2*b*, when the garment is worn.

The seams 230 may be quilting seams, for example. Seams 230 may also be formed by construction methods known in the art, including but not limited to chemical bonding, mechanical bonding, thermal bonding, adhesives, bonding tape, fusible threads and/or materials, welding, such as ultrasonic welding, radio frequency welding, etc., stitching, for example, blanket stitches, chain stitches, cross-stitches, embroidery stitches, garter stitches, lockstitches, straight stitches, zigzag stitches, stretch stitches, overlock stitches, coverstitches, topstitches, etc., rivets, heat treatment, or any combination thereof. Furthermore, the seams or portions of the seams may include a seal which makes it more difficult for heat, air, liquid, dirt, etc. to pass through the seams 230, particularly from the outside. In some embodiments, other types of connections 230 may be used. For example, the respective first and second insulation elements 210 and 220 may also be connected to each other via bars or connection areas designed in a different manner.

Two first and two second insulation elements 210 and 220 are illustrated in FIGS. 2*a*-2*c*, but a person of ordinary skill in the relevant art will understand that any suitable number of first and/or second insulation elements 210, 220 may be used to achieve the desired characteristics. There may also be only one first insulation element 210 and one second insulation element 220. However, for simplicity, the plural will be used in the following description of the heat insulation structure 200.

The first insulation elements 210 may have a different initial shape than the second insulation elements 220. As shown in FIGS. 2*a* and 2*c*, the initial shape of the insulation elements refers to the shape of the insulation elements 210, 220 in an unloaded or uncompressed state, i.e. in a state in which no pressure is exerted on the heat insulation structure 200, for example by a wearer of a jacket.

Moreover, each first insulation element 210 is connected to a second insulation element 220. In certain embodiments, the first insulation elements 210 and the second insulation elements 220 are alternatingly arranged alongside each other, as shown in FIGS. 2*a*-2*c*. It may be beneficial in this regard if all insulation elements 210, 220 are alternatingly connected to each other, e.g. in order to provide a continuous heat insulation structure 200 as shown here.

The second insulation elements 220 may be deformed during use such that contact areas 250, where the first insulation elements 210 contact the second insulation elements 220, are increased by pressure on an inside (cf. FIG. 2*c*) of the heat insulation structure 200, created when wearing the garment. FIG. 2*b* depicts the insulated elements during use, for example, if used in a jacket or vest when a person is wearing the jacket or vest. The contact between the first and the second insulation elements 210 and 220 can occur directly, as depicted in FIG. 2*b*.

If, for example, the jacket comprises a further inner layer (not shown), which is arranged on the inside of the heat insulation structure 200, the contact between the first and the second insulation elements 210 and 220 may also occur indirectly, for example by a contact of such an inner layer in the respective areas.

As previously mentioned, the insulation elements 210, 220 are deformable. A given second insulation element 220 may be deformed during use such that part of the second insulation element 220 covers an adjacent seam 230 or a portion of a seam 230. Specifically, the second insulation elements 220 may be configured to substantially overlap adjacent seams 230 during use such that heat loss at the seams 230 is reduced. For example, when a user wears a garment having second insulation elements 220, a body or parts of the body of the user may exert a force on the second insulation elements 220 such that they are pressed against the seams 230 and/or the first insulation elements 210. This may result in the second insulation elements 220 overlapping the adjacent seams 230 with both layers 212, 214 and fill material.

To increase contact areas 250, the second insulation elements 220 may, for example, be substantially thicker than the first insulation elements 210 as shown in FIG. 2*c*. Thicknesses 260 or 265 of the first or the second insulation elements 210 and 220 may for example, as shown in FIG. 2*c*, be measured from a plane 280 which intersects the first and second insulation elements 210 and 220 as well as the seams 230, in a direction 285 substantially perpendicular to the inside of the heat insulation structure 200. When the jacket is worn, the surfaces of the second insulation elements 220 may come into contact with the surface of the wearer and are deformed by the pressure on the inside of the heat insulation structure 200 created by a wearer's body during use. As previously mentioned, this situation is illustrated in FIG. 2*b*. In some embodiments, the first insulation elements 210 may also undergo deformation. These increased contact areas 250 in which the first insulation elements 210 contact the second insulation elements 220 may in particular reduce an escape of body heat.

Moreover, in a cross-section of the heat insulation structure 200, the first arc 224 along the inner surface of the second insulation elements 220 may comprise a greater length A than the length B of the second arc 222 in the cross-section along the outer surface of the second insulation elements 220. The inner surface and the outer surface may, e.g., be delimited by the plane 280 mentioned above.

A ratio of the length of the first arc 224 to the length of the second arc 222, i.e., a ratio of length A to length B, may be in a range from about 1.2:1-3:1, may further be in the range of 1.4:1-2:1, and may yet further be in the range of 1.45:1-1.55:1. For example, a ratio of the length A of the first arc 224 to the length B of the second arc 222, i.e. A:B, may be approximately 1.5:1.

As also shown in FIG. 2*c*, a height D of the second insulation elements 220 may be measured, for example, along the plane 280. The height D may in particular be measured between two seams 230 adjacent to a second insulation element 220. The length A of the first arc 224 may be longer than the height D of the second insulation elements 220.

In some embodiments, a ratio of the length A of the first arc 224 to a height D of the second insulation elements 220, i.e. A:D, may be in the range of 1.2:1-3:1, may further be in the range of 1.3:1-2.5:1, and may yet further be in the range of 1.4:1-2.1:1. For example, a ratio of the length A of the first arc 224 to height D of the second insulation elements 220, i.e. A:D, may be approximately 2.0.

As already mentioned before, these ranges for the values A:B or A:D may apply to all second insulation elements 220. In certain embodiments, these ranges for the values A:B or A:D may apply only to a subset of the second insulation elements 220.

Moreover, the ratios A:B and A:D may both lie in the ranges indicated above at the same time. It may also be possible, however, that only one ratio, e.g. the ratio A:B, lies in a range whereas the other ratio, in the example A:D, does not lie in a range, or vice versa.

In the heat insulation structure 200 shown in FIGS. 2*a*-2*c*, the first and second insulation elements 210 and 220 are elongated. In this regard, insulation elements 210, 220 are referred to as elongated as they extend for a length substantially longer than a height, e.g. height D, of the insulation elements 210, 220, measured, for example, along the plane 280 and between respective adjacent seams 230.

In some embodiments, the first and second insulating elements 210, 220 have cross-sections that depend in part on the materials used in the layers 212, 214, the amount of material used to construct each insulating element 210, 220, the fill material, the volume and weight of fill material, stitching, or other structural devices used in the insulating elements 210, 220, among other variables. Generally, insulating elements 210, 220 may have cross-sections including but not limited to curved elements, such as circles, ovals, ellipses, or portions thereof, rectangles, triangles, irregular shapes, tubes, free-form geometries and/or combinations thereof. For example, as depicted in FIGS. 2*a*-2*c*, the cross-section of the insulating elements 210, 220 are substantially curved. In some instances, the cross-sections of the insulation elements are substantially oval or elliptical. For example, seams or the like may be present due to the manufacture of the insulation elements 210 and 220, so that the insulation elements 210, 220 deviate from an exactly regular shape such as a round or oval shape. Further possible embodiments of insulation elements are described further below.

The first insulation elements 210 may define chambers or cavities 215, and the second insulation elements 220, in turn, may define chambers or cavities 225.

The first insulation elements 210 and/or the second insulation elements 220 may comprise a filling material or insulating material. This may be arranged in the chambers 215 or 225. The chambers 215 or 225 may for example be filled by such a filling material. Filling materials or insulating materials may include but are not limited to natural fibers, for example, animal fibers, such as wool, plant fibers, or feathers, particularly down; synthetic fibers, for example, fibers of polyesters, polyethylene terephthalate, mixtures of polyethylene terephthalate and polypropylene, polyethylene terephthalate-polyethylene isophthalate copolymer, acrylic and mixtures thereof; synthetic microfiber insulation; mixtures of synthetic microfibers and macrofibers; and/or combinations of any of these types of fibers, for example a mixture of natural and synthetic filling materials.

Synthetic fibers provide good insulating properties in a humid state, for example, and are conceivable as the filling or insulating material here. In a dry state, in contrast, down comprise very good heat insulating properties while having an extremely low weight. Certain embodiments comprise mixtures of such materials. Air, gels, foam materials, liquids, gases or solids such as granules, may also be used as the filling material.

Evacuated cavities, for reducing heat convection, may also be included in certain embodiments. Moreover, the filling amounts and/or filling density of the respective filling material may vary between the first and second insulation elements 210 and 220. In certain embodiments, the filling amount and/or the filling density of the individual first insulation elements 210 varies and/or that the filling amount and/or the filling density of the individual second insulation elements 220 varies. Finally, the filling amount/filling density may also be provided in an inhomogeneous manner within a single insulation element 210 or 220.

The second insulation elements 220 may have significantly more filling material than first insulation elements 210. In some instances, e.g., a ratio of a weight of filling material in the second insulation elements 220 to a weight of filling material in the first insulation elements 210 may be in the range of 1.3:1-4:1, may further be in the range of 1.4:1-3:1, and may yet further be in the range of 1.45:1-2:1. For example, a heat insulation structure 200 may have a ratio of weight of filling material in the second insulation elements 220 to the first insulation elements 210 of about 1.5. Again, this may hold for all first and second insulation elements 210, 220, or only a subset thereof.

Moreover, instead of considering the ratio of the weight of the filling material in the second insulation elements 220 to the weight of the filling material in the first insulation elements 210, a ratio of the volume of the filling material in the second insulation elements 220 to a volume of the filling material in the first insulation elements 210 may be considered, as already mentioned above, and for this ratio of filling volumes, e.g. the same ratios as mentioned above with respect to the filling weight may apply.

The first insulation elements 210 and/or the second insulation elements 220, or a subset thereof, may be provided in elongated form, as already mentioned above.

Further, insulation elements which are elongated members may have any cross-sectional geometry including but not limited to round, oval, rectangular, triangular, or combinations thereof, and the extension of which in a longitudinal direction is considerably greater than a width or height of the insulation elements.

In certain embodiments, the first insulation elements 210 and the second insulation elements 220, or some of them, may be arranged substantially horizontal when the garment is worn. This may, particularly in case of application in garments, avoid potential filling material moving downward due to gravity, which could otherwise result in inconsistent distribution of the filling material within the insulation elements 210 and 220 of the heat insulation structure 200 and thus an insufficient insulation in the higher areas. In certain embodiments, some or all of the first and second insulation elements 210, 220 are arranged in the garment in a V-shape. This can, for example, further improve a consistent distribution of filling material in the first and/or second insulation elements 210 and 220, since such insulation elements 210, 220 arranged in a V-shape may also ensure a certain fixation in a direction perpendicular to the body axis, e.g. in a horizontal direction. Thus, the V-shape may nonetheless be selected in a sufficiently horizontal manner such that a negative influence of gravity, for example, may be largely avoided.

In certain embodiments, some first and/or second insulation elements 210, 220 are arranged substantially horizontal and some first and/or second insulation elements 210, 220 are arranged in a V-shape within a garment.

In further embodiments, the heat insulation structure 200 may comprise at least one cover layer (not shown) which may be arranged on the inside or the outside of the heat insulation structure 200. This may be an inner lining, for example, which increases wearing comfort and further increases heat insulation. Moreover, outer layers that serve the purpose of repelling water, dirt, wind, etc. may also be included in some embodiments. In this regard, the cover layer may comprise one or several of the following materials, for example: a weft-knitted, warp-knitted and/or woven textile made from natural and/or synthetic materials. Additionally, the textile may be treated with a durable water repellant (e.g., DWR).

Further embodiments of heat insulation structures according to the invention are discussed below. In order to avoid repetitions, however, merely the differences from the heat insulation structure 200 discussed above in connection with FIGS. 2*a*-2*c* will be considered in detail. As for the rest, the statements made regarding the heat insulation structure 200 and the mentioned design possibilities also apply, if applicable, to all subsequent embodiments.

It further ought to be pointed out that merely a cross-section through the respective heat insulation structure is shown in FIGS. 3*a*-3*d*, 4, 5*a*-5*b*, and 9*a*-9*b* for the purpose of simplified illustration, meaning that the latter may furthermore extend into the image plane and out of it.

FIGS. 3*a*-3*d* show further possible embodiments of heat insulation structures 300*a*, 300*b*, 300*c*, 300*d* according to the invention, which differ from the heat insulation structure 200 mainly by the design and arrangement of the first and/or second insulation elements or more precisely by their initial shape. The afore-described functioning for sealing off seams and the like remains substantially the same.

Figure 3A:
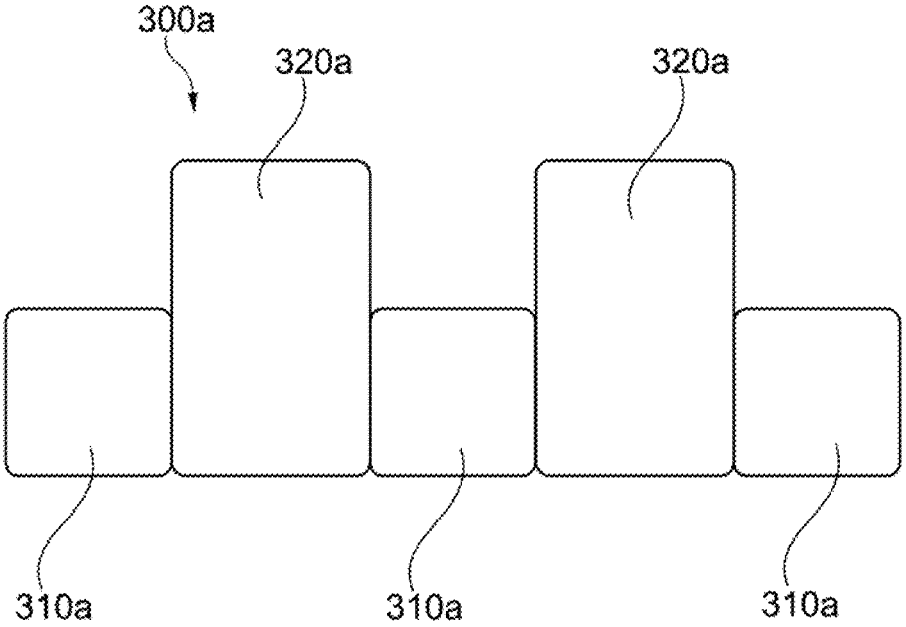
FIGS. 3*a*-3*d* are views of heat insulation structures, according to certain embodiments of the present invention.

FIG. 3*a*, for example, shows embodiments of a heat insulation structure 300*a* according to the invention, which comprises a plurality of first insulation elements 310*a* and a plurality of second insulation elements 320*a*. Herein, the first and second insulation elements 310*a* and 320*a* comprise a substantially rectangular cross-section. As best illustrated in FIG. 3*a*, this configuration may result in the first and second insulation elements 310*a* and 320*a* lying closely against each other even without the external pressure created by the wearer. As a result, the heat insulation structure 300*a* may comprise particularly good insulating properties on its own accord. Also, as illustrated in FIG. 3*a*, the second insulation elements 320*a* may comprise, without the pressure created by wearing, a greater thickness in a direction perpendicular to the inside of the heat insulation structure 300*a* (at the top in FIG. 3*a*) than the first insulation elements 310*a*. As a result, the second insulation elements 320*a* are deformed by the pressure on the inside of the heat insulation structure 300*a* caused during wearing such that contact areas in which the first insulation elements 310*a* contact the second insulation elements 320*a* are enlarged.

Figure 3B:
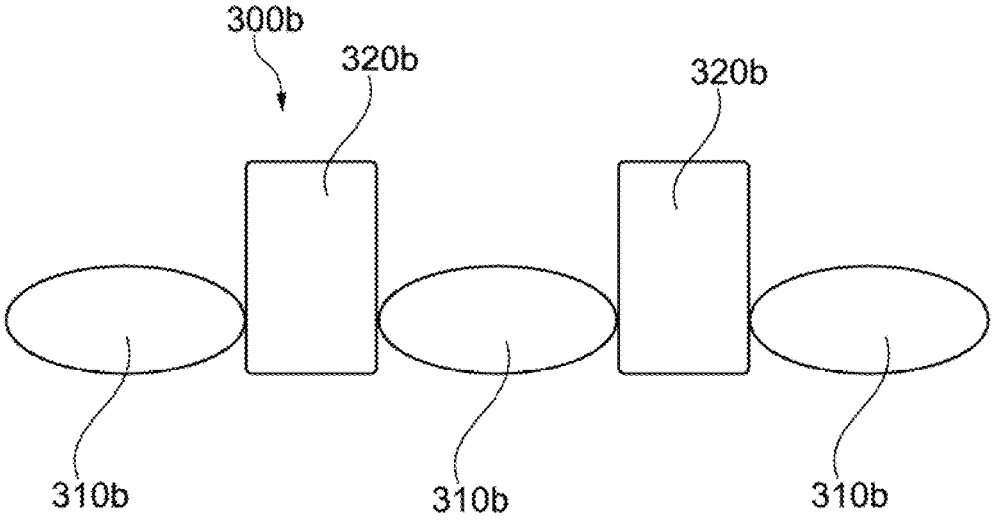
Figure 3C:
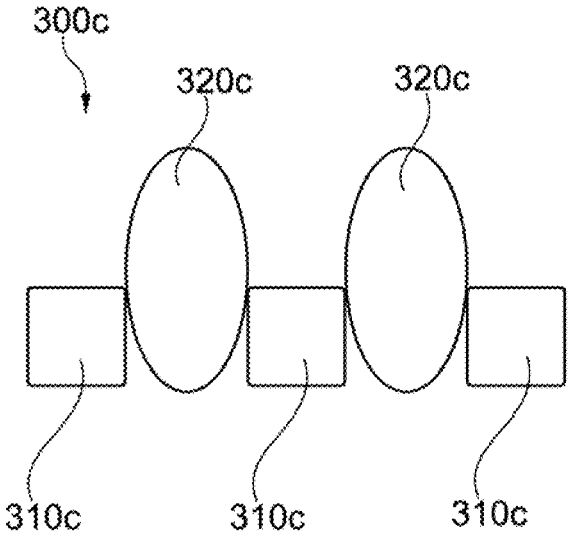

Analogous statements also apply to the embodiments of heat insulation structures 300*b* and 300*c*, as shown in FIGS. 3*b* and 3*c*, with the exception of the initial shape, particularly the cross-sectional shape, of the insulation elements. For example, in the heat insulation structure 300*b*, the first insulation elements 310*b* are tubular in shape and the second insulation elements 320*b* are rectangular in cross-section. In contrast, in the heat insulation structure 300*c*, the first insulation elements 310*c* are rectangular in cross-section and the second insulation elements 320*c* are tubular in shape. The second insulation elements 320*b*, 320*c* each comprise a greater thickness in a direction perpendicular to the inside of the heat insulation structure 300*b*, 300*c* (at the top in the image) than the first insulation elements 310*b*, 310*c*.

Figure 3D:
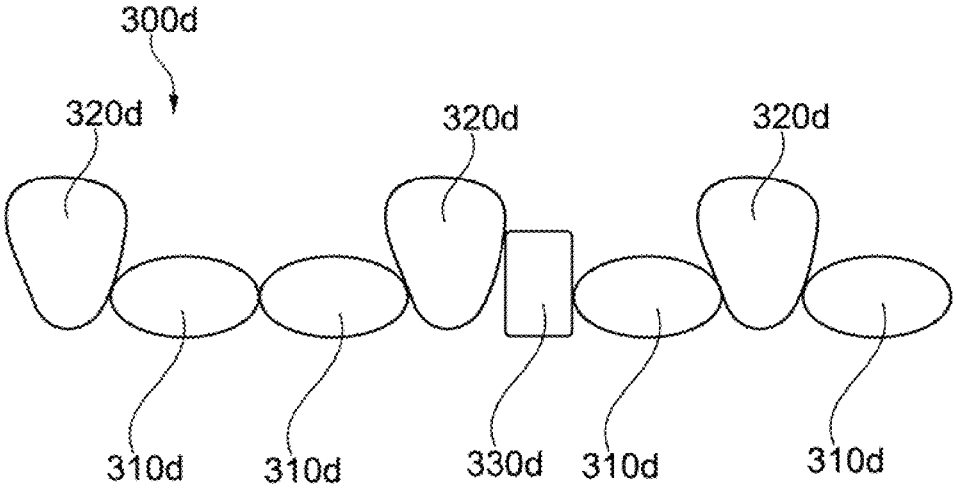

Finally, the embodiments of a heat insulation structure 300*d* illustrated in FIG. 3*d* clarifies that the first insulation elements 310*d* and the second insulation elements 320*d* do not necessarily have to be arranged alongside each other in an alternating fashion. As shown in FIG. 3*d*, first insulation elements 310*d* may be connected to a second insulation element 320*d* and/or in some instances to another first insulation element 310*d*. Further, an element 330*d* may be positioned at various points in the heat insulation structure 300*d*. Element 330*d* may include structures capable of providing functionality specific to the needs for a specific garment. For example, element 330*d* may be constructed such that it provides breathability and/or ventilation, allows for threading of materials, such as wires, cables or the like, and/or insulation. Such further elements may also be a part of other embodiments of heat insulation structures according to the invention described herein, even if they are not explicitly shown.

An alternating arrangement and connection of first and second insulation elements may be desirable in certain embodiments. For example, such an arrangement may provide for multiple seams and/or connection areas between the first and second insulation elements to be sealed off by contact areas that are enlarged as much as possible by exerted pressure. Moreover, the recurring arrangement may increase wearing comfort.

A person of ordinary skill in the relevant art will understand that not all possible combinations and arrangements of first, second and, if applicable, further elements can be indicated here, but that such combinations are understood from his or her knowledge and such embodiments also are part of the invention.

Figure 4:
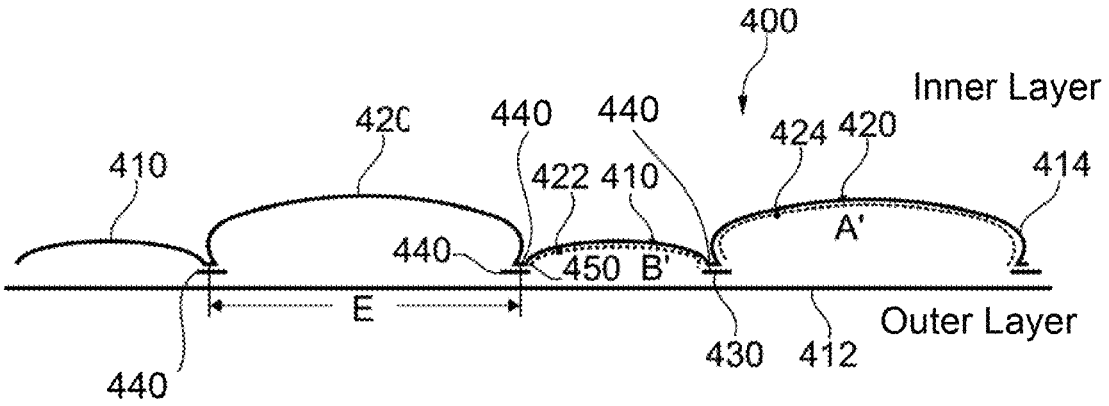
FIG. 4 is a view of a heat insulation structure, according to certain embodiments of the present invention.

FIG. 4 shows additional embodiments of a heat insulation structure 400. Heat insulation structure 400 includes layers 412 and 414. As shown in FIG. 4, layer 412 may include a single piece or fabric. Layer 414 may be coupled to layer 412 by a seam 430. As depicted in FIG. 4, seam 430 may include bonding tape 440, as well as stitching 450. Further, the seam 430 may include a combination of construction methods as described herein.

As shown in FIG. 4, the first insulation elements 410 have a different initial shape than the second insulation elements 420. In some embodiments, the length A' of the arc 424 of the second insulation elements 420 may be longer than the length B' of the arc 422 of the first insulation elements 410.

Moreover, a ratio of the length A' of the arc 424 of the second insulation elements 420 to a height E of the second insulation elements 420, i.e., a ratio of length A' to height E, may be in a range of 1.2:1-3:1, may further be in the range of 1.3:1-2.5:1, and may yet further be in the range of 1.4:1-2.1:1. For example, a ratio of the length A' of the arc 424 to height E of the second insulation elements 420, i.e., A':E, may be approximately 1.5.

In further embodiments, layer 412 may be constructed of multiple pieces of material coupled together. Pieces of material used may be chosen for particular properties or characteristics of the material.

Figure 5A:
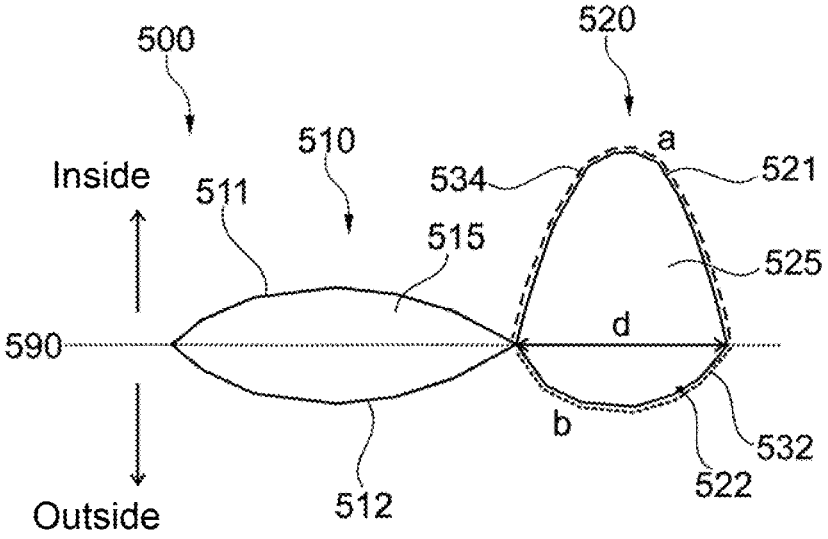
FIGS. 5*a*-5*b* are views of a heat insulation structure with an outer layer and an inner layer, along with an exemplary manufacturing method, according to certain embodiments of the present invention.
Figure 5B:
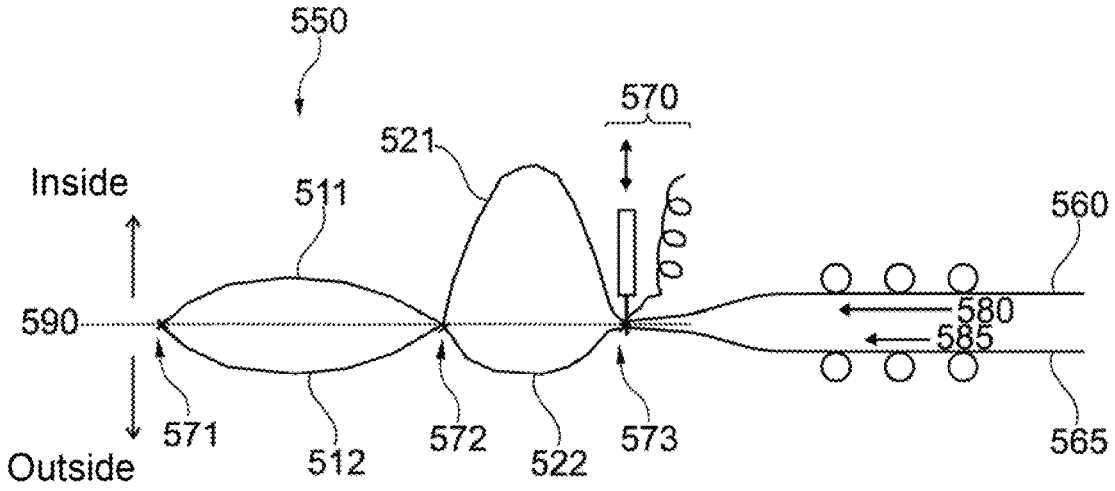

FIGS. 5*a*-5*b* shows further embodiments of a heat insulation structure 500 according to the invention and a manufacturing method 550. The heat insulation structure 500 may, for example, be one of the afore-described embodiments of a heat insulation structure, such as the heat insulation structure 200.

The heat insulation structure 500 comprises one or a plurality of first insulation elements 510 and one or a plurality of second insulation elements 520. In order to simplify the illustration only one of each is shown. At least one of the first insulation elements 510 comprises an inner layer 511 and an outer layer 512, which define a cavity 515. At least one of the second insulation elements 520 also comprises an inner layer 521 and an outer layer 522, which define a cavity 525. In certain embodiments, all first and second insulation elements 510, 520 comprise respective inner layers 511, 521 and outer layers 512, 522 defining cavities 515, 525.

The surface area of the inner layer 511 of the first insulation elements 510 (again, the plural is used in the following for simplicity) is less than the surface area of the inner layer 521 of the second insulation elements 520.

Moreover, in certain embodiments, as shown in FIGS. 5*a*-5*b*, the surface area of the inner layer 511 of the first insulation elements 510 is substantially of equal size as the surface area of the outer layer 512 of the first insulation elements 510. The surface area of the inner layer 521 of the second insulation elements 520, in contrast, is larger than the surface area of the outer layer 522 of the second insulation elements 520.

This construction results, potentially after filling of the cavities 515 and 525, in the second insulation elements 520 comprising a greater thickness than the first insulation elements 510 in a direction perpendicular to the inside, as shown in FIGS. 5*a*-5*b*.

In this regard, as shown in FIGS. 5*a*-5*b*, the inner layers 511 and 521 of the first and second insulation elements 510 and 520 may be jointly provided as an integral piece. As a result, a consistent inner layer may be achieved. Furthermore, the outer layers 512 and 522 of the first and second insulation elements 510 and 520 may be jointly provided as an integral piece. Such a construction may provide a consistent outer layer in certain embodiments. If both the inner layer and the outer layer are provided as an integral piece, this construction may improve stability as well as the heat-insulating, water-tight, and dirt-repellant properties, etc. of the heat insulation structure 500. Further, it may simplify manufacture and/or reduce costs.

Moreover, in certain embodiments as shown here, in a cross-section of the heat insulation structure 500, a first arc 534 along the inner surface 521 of the second insulation elements 520 comprises a greater length a than the length b of a second arc 532 in the cross-section along the outer surface 522 of the second insulation elements 520. The inner surface and the outer surface may, e.g., be delimited by the plane 590 shown in FIGS. 5*a*-5*b*, intersecting the first and second insulation elements 510, 520 and, if present, the seams 571, 572, 573.

A ratio of the length of the first arc 534 to the length of the second arc 532, i.e., a ratio of length a to length b, may be in a range from about 1.2:1-3:1, may further be in the range of 1.4:1-2:1, and may yet further be in the range of 1.45:1-1.55:1. For example, a ratio of the length a of the first arc 534 to the length b of the second arc 532, i.e. a:b, may be approximately 1.5:1.

As also shown in FIG. 5*a*, a height d of the second insulation elements 520 may be measured, for example, along the plane 590. The height d may in particular be measured between two seams 572, 573 adjacent to a second insulation element 520. The length a of the first arc 534 may be longer than the height d of the second insulation elements 520.

In some embodiments, a ratio of the length a of the first arc 534 to height d of the second insulation elements 520, i.e. a:d, may be in the range of 1.2:1-3:1, may further be in the range of 1.3:1-2.5:1, and may yet further be in the range of 1.4:1-2.1:1. For example, a ratio of the length a of the first arc 534 to height d of the second insulation elements 520, i.e. a:d, may be approximately 2.0.

A possible manufacturing method 550 for a heat insulation structure 500 is shown in FIG. 5*b*, for example. The inner layer 560 may be provided as an integral piece and the outer layer 565 may be provided as an integral piece can be fed to a sewing table 570, for example, at variable speeds, suggested by the arrows 580 and 585, which sews the inner layer 560 and the outer layer 565 together. Herein, a seam in a V-shape running in a direction perpendicular to the image plane may e.g. also be created, in order to manufacture first and second insulation elements 510 and 520 in a V-shape. In order to manufacture the first insulation elements 510, the inner layer 560 and the outer layer 565 may be fed to the sewing table 570 at the same speed 580 and 585, respectively, between two seams 571 and 572 delimiting a first insulation element 510 being sewn. As a result, the surface areas of the sections 511 and 512 of the inner and the outer layer 560 and 565 are approximately the same size. In contrast, in order to manufacture the second insulation elements 520, the inner layer 560 may be fed to the sewing table 570 at a greater speed 580 than the outer layer 565 between two seams 572 and 573 delimiting a second insulation element 520 being sewn. As a result, the surface area of the section 521 of the inner layer 560 is created larger than the surface area of the section 522 of the outer layer 565. After the sewing table 570 has been passed through, the cavities 515 and/or 525 may potentially be filled with a filling or insulating material and the first and second insulation elements 510 and 520 may, if necessary, be sewn together at their ends.

The constructions described herein may enable garments utilizing the heat insulation structures to be assembled by machine or at least parts of the garments may be assembled by machine.

Heat insulation structures as described herein may be combined with conventional structures to produce a garment. Heat insulation structures 200, 300*a*-*d*, 400, 500, 900*a*-*b*, potentially in combination with conventional structures 100, may be positioned corresponding to areas of the user most vulnerable to heat loss. These heat insulation structures may further be combined with structures designed to allow for additional breathability, mobility, comfort, protection from the elements (i.e., wind, rain, humidity, etc.) and/or utility.

A garment including but not limited to a jacket, vest, insulated pants, hat, mittens, gloves, or the like with embodiments of a heat insulation structure 200, 300*a*-*d*, 400, 500, 900*a*-*b* according to various embodiments of the invention constitutes a further aspect of the invention.

FIGS. 6*a*-6*e* show embodiments of jacket 600 with embodiments of a heat insulation structure according to the invention. The inside of the jacket 600 is shown in each case.

Figure 6A:
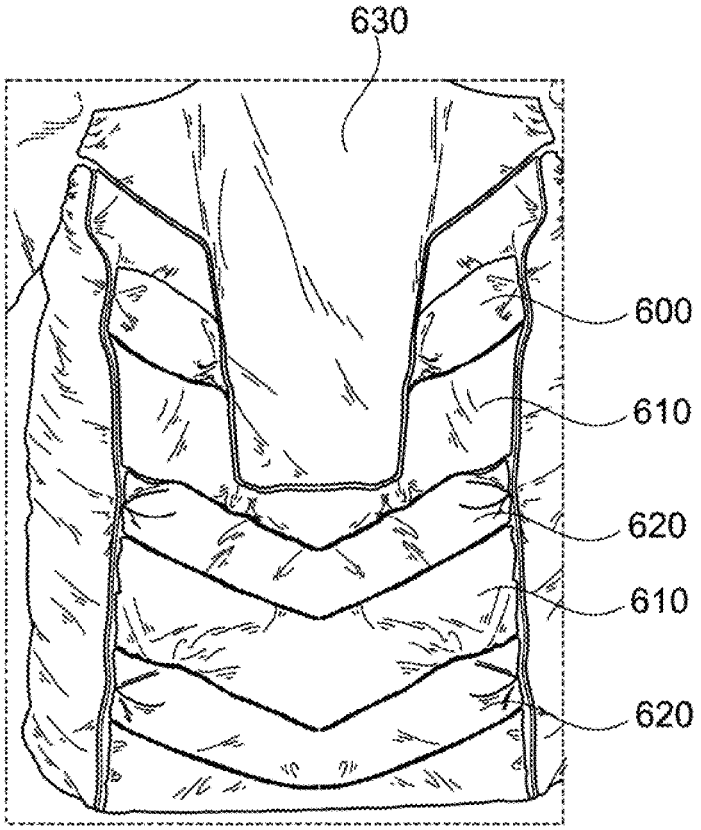
FIGS. 6*a*-6*e* are embodiments of an outdoor jacket with a heat insulation structure, according to certain embodiments of the present invention.
Figure 6B:
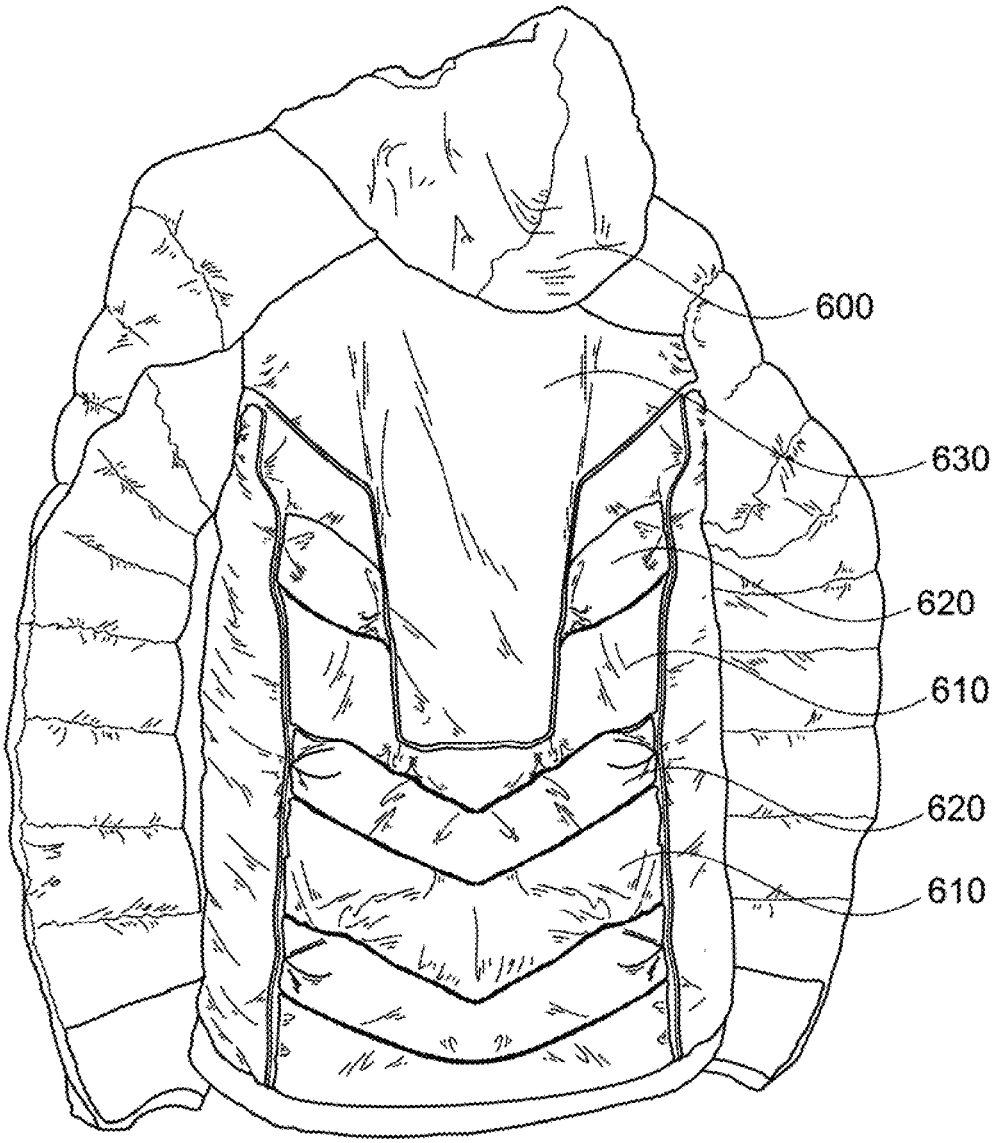
Figure 6C:
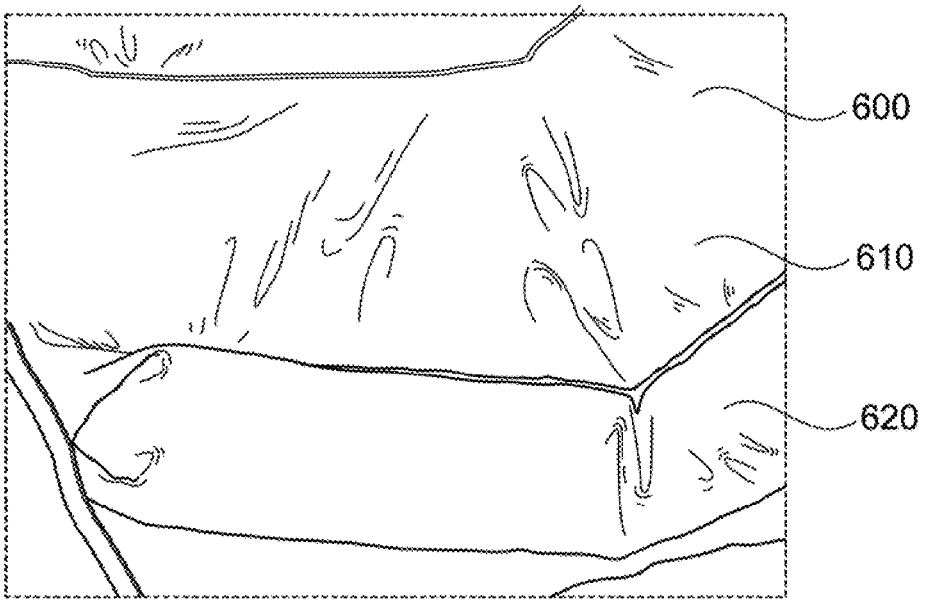
Figure 6D:
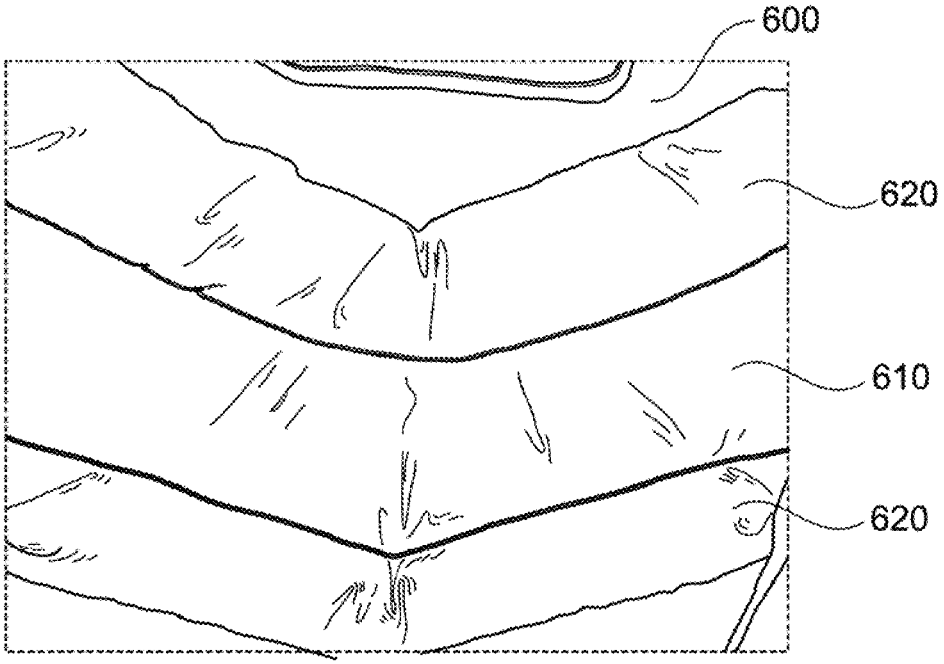
Figure 6E:
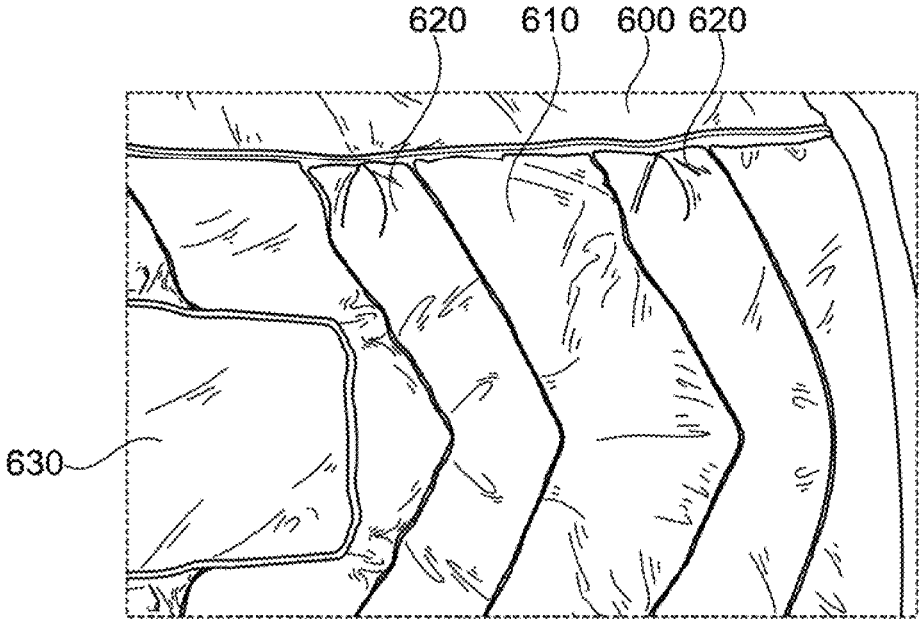

A plurality of first insulation elements 610 and a plurality of second insulation elements 620 are visible. In these embodiments, at least some of the first and second insulation elements 610 and 620 comprise a V-shape. Here, the insulation elements 610 and 620 are filled with a filling material, for example down or a synthetic fiber material. Furthermore, as illustrated in FIGS. 6*c*-6*e*, when the jacket 600 is not worn, i.e. without the pressure exerted on the inside by the wearer, the second insulation elements 620 comprise a greater thickness in a direction perpendicular to the inside of the jacket 600 or the heat insulation structure, respectively, than the first insulation elements 610. Here, the ratio of the thicknesses amounts to approximately 3:1.

The first and second insulation elements 610, 620 are predominantly arranged around the trunk of the wearer's body, since this part of the body can potentially lead to large amounts of heat loss. In the areas of the shoulders and the neck, on the other hand, that may e.g. be covered by a backpack and may represent high-sweat areas, a different, more breathable material 630 may be included.

Figure 7:
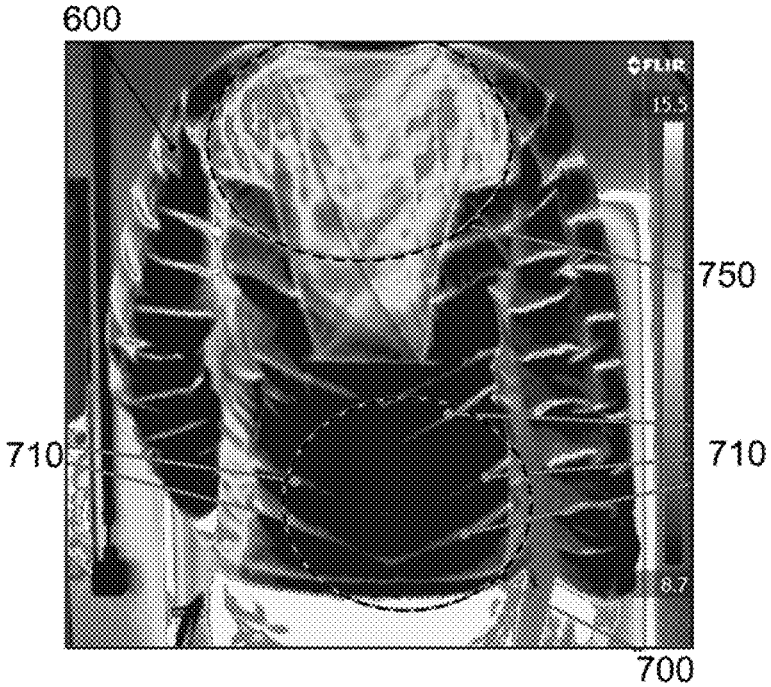
FIG. 7 is a thermal image of the outdoor jacket shown in FIGS. 6*a*-6*e*.

FIG. 7 illustrates a thermal image of the jacket 600 taken under the same environmental conditions as the thermal image of the conventional jacket 160 in FIG. 1*d*. It can clearly be gathered from the image in FIG. 7 that a temperature below approximately 10° C. was constantly measured in the lower back area 700, the inside of which can be seen in FIGS. 6*a*-6*e*, particularly also in the areas 710 in which the seams of the jacket 600 are located. Thus, the jacket 600 comprises considerably less heat holes than the conventional jacket 160. A clear reduction of heat holes may also be detected in the areas of the arms of the jacket 600, in which heat insulation structures according to the invention are also located.

In contrast, in the area 750 of the breathable material 630, a more pronounced loss of body heat is visible.

Figure 8A:
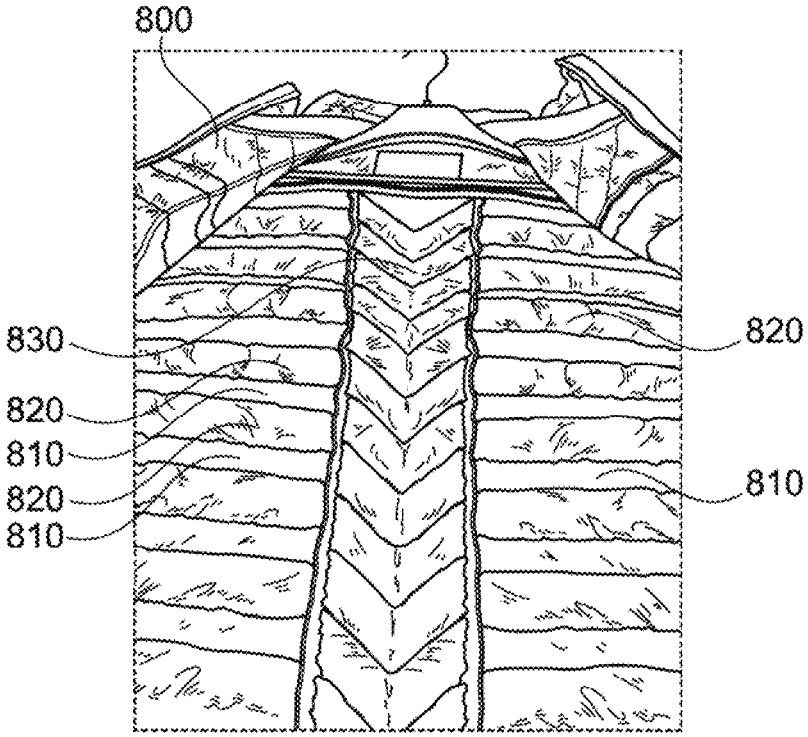
FIGS. 8*a*-*b* are views of a heat insulation structure, according to certain embodiments of the present invention.
Figure 8B:
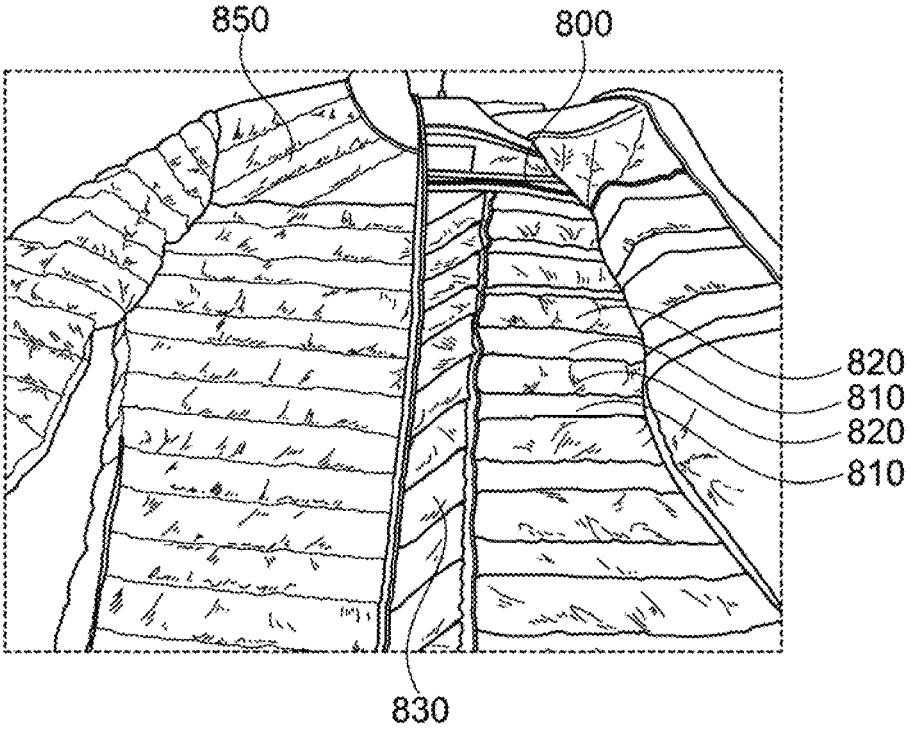

FIGS. 8*a*-8*b* show embodiments of a jacket 800 with embodiments of a heat insulation structure according to the invention. The jacket comprises a plurality of first insulation elements 810 and a plurality of second insulation elements 820 arranged alternatingly alongside each other. In these embodiments, the first and second insulation elements 810, 820 may be elongated and may be arranged horizontally on the left and right half of the torso of the wearer. In the middle of the back of the jacket 800, further insulation elements 830, provided in a V-shape, may be arranged. These insulation elements 830 may or may not provide the inventive "sealing" effect of heat holes.

The jacket may also comprise an outer cover layer 850, e.g. a water repellant outer cover layer 850, arranged on the outside of the jacket 800 with inventive heat insulation structure. The outer layer 850 may also serve design purposes.

While no first and second insulation elements 810, 820 are arranged, e.g., in the sleeves of the jacket 800 in the embodiments illustrated in FIGS. 8*a*-8*b*, in other embodiments of an inventive jacket, the sleeves may contain first and second insulation elements providing the inventive sealing function of heat holes in those regions, too.

Figure 9A:
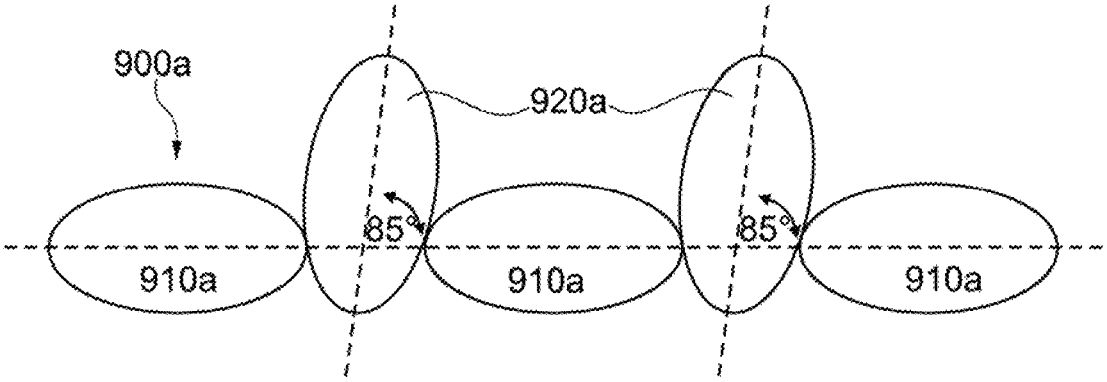
FIGS. 9*a*-*b* are views of heat insulation structures, wherein the first and second insulation elements comprise different initial orientations, according to certain embodiments of the present invention.
Figure 9B:
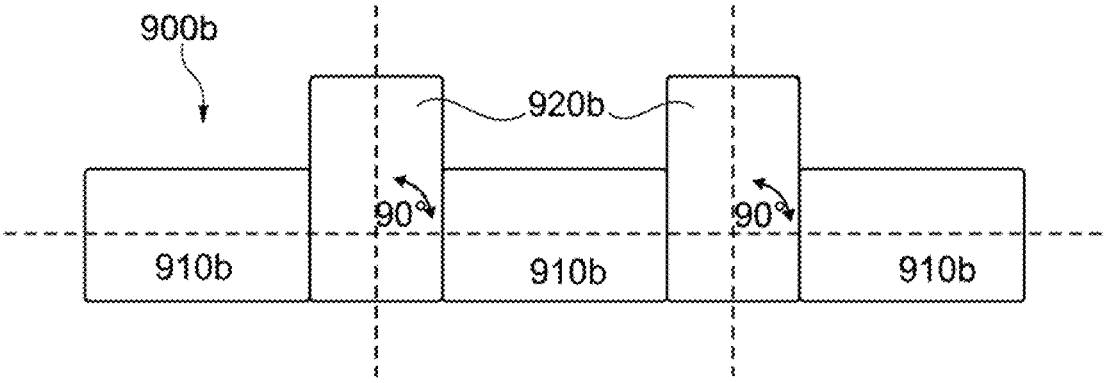

Finally, FIGS. 9*a*-9*b* show further embodiments of heat insulation structures 900*a* and 900*b* according to the invention. In these embodiments, the first insulation elements 910*a* or 910*b* and the second insulation elements 920*a* or 920*b*, respectively, have the same initial form but differ in their initial orientation. Such embodiments are also covered by the term "different initial shape," as already explained above. The first insulation elements 910*a* or 910*b* and the second insulation elements 920*a* or 920*b*, respectively, may further comprise a different cross-sectional orientation.

The form and orientation is considered here once again as the initial form or initial orientation of the insulation elements 910*a*, 910*b* as well as 920*a*, 920*b*, that they comprise in the unloaded state, i.e. when no pressure is exerted on them.

In this regard, as suggested by the dashed lines in FIGS. 9*a*-9*b*, in the heat insulation structure 900*a* the first insulation elements 910*a*, shown in oval (cross-sectional) form here, are rotated by approximately 85° with respect to their cross-section in relation to the second insulation elements 920*a*, also shown in an oval form here. In the heat insulation structure 900*b*, in contrast, the first insulation elements 910*b*, shown in rectangular form here, are rotated by approximately 90° with respect to their cross-section in relation to the second insulation elements 920*b*, also shown in rectangular form here. Other rotational angles are also conceivable, e.g. in a range from 80° to 100°.

In the following, further examples are described to facilitate the understanding of the invention:

1. A heat insulation structure (200; 300*a*-*d*; 400; 500) for a garment (600; 800) with
   a. a first insulation element (210; 310*a*-*d*; 410; 510; 610; 810); and
   b. a second insulation element (220; 320*a*-*d*; 420; 520; 620; 820), wherein the second insulation element (220; 320*a*-*d*; 420; 520; 620; 820) comprises a different initial shape than the first insulation element (210; 310*a*-*d*; 410; 510; 610; 810);
   c. wherein the first insulation element (210; 310*a*-*d*; 410; 510; 610; 810) is connected to the second insulation element (220; 320*a*-*d*; 420; 520; 620; 820); and
   d. wherein the second insulation element (220; 320*a*-*d*; 420; 520; 620; 820) is deformed when wearing the garment (600; 800) by a pressure on an inside of the heat insulation structure (200; 300*a*-*d*; 400; 500) such that a contact area (250), in which the first insulation element (210; 310*a*-*d*; 410*a*-*b*; 510; 610; 810) contacts the second insulation element (220; 320*a*-*d*; 420*a*-*b*; 520; 620; 820) is increased.
2. Heat insulation structure (200; 300*a*-*d*; 400; 500) according to the preceding example, comprising a plurality of first insulation elements (210; 310*a*-*d*; 410; 510; 610; 810) and a plurality of second insulation elements (220; 320*a*-*d*; 420; 520; 620; 820), wherein the second insulation elements (220; 320*a*-*d*; 420; 520; 620; 820) each comprise a different initial shape than the first insulation elements (210; 310*a*-*d*; 410; 510; 610; 810), wherein each first insulation element (210; 310*a*-*d*; 410; 510; 610; 620) is connected to at least one second insulation element (220; 320*a*-*d*; 420; 520; 620, 820), and wherein the second insulation elements (220; 320*a*-*d*; 420; 520; 620; 820) are deformed when wearing the garment (600; 800) by a pressure on the inside of the heat insulation structure (200; 300*a*-*d*; 400; 500) such that contact areas (250), in which the first insulation elements (210; 310*a*-*d*; 410*a*-*b*; 510; 610; 810) contact the second insulation elements (220; 320*a*-*d*; 420*a*-*b*; 520; 620; 820) are increased.
3. Heat insulation structure (200; 300*a*-*d*; 400; 500) according to one of the preceding examples, wherein at least one first insulation element (210; 310*a*-*d*; 410; 510; 610; 810) and at least one second insulation element (220; 320*a*-*d*; 420; 520; 620; 820) are connected at a respective seam (230; 430; 571; 572; 573) and wherein the increased contact area (250) is proximate to the seam (230; 430; 571; 572; 573) such that the at least one second insulation element (220; 320*a*-*d*; 420; 520; 620; 820) substantially overlaps the seam (230; 430; 571; 572; 573) when the garment (600; 800) is worn.
4. Heat insulation structure (200; 300*a*-*d*; 400; 500) according to one of the preceding examples, wherein the increased contact area (250), in which at least one first insulation element (210; 310*a*-*d*; 410; 510; 610; 810) contacts at least one second insulation element (220; 320*a*-*d*; 420; 520; 620; 820), reduces an escape of body heat.

5. Heat insulation structure (200; 300*a-d*; 400; 500) according to one of the preceding examples, wherein in a cross-section of the heat insulation structure a first arc (224, 534) along an inner surface of at least one second insulation element (220; 320*a-d*; 420; 520; 620; 820) comprises a greater length (A; a) than a length (B; b) of a second arc (222, 532) in the cross-section along an outer surface of the at least one second insulation element (220; 320*a-d*; 420; 520; 620; 820).

6. Heat insulation structure (200; 300*a-d*; 400; 500) according to the preceding example, wherein a ratio of the length (A; a) of the first arc (224, 534) to the length (B; b) of the second arc (222, 532) lies in the range of 1.2:1-3:1, further lies in the range of 1.4:1-2:1, and yet further lies in the range of 1.45:1-1.55:1.

7. Heat insulation structure (200; 300*a-d*; 400; 500) according to one of the preceding examples, wherein a ratio of the length (A; a) of the first arc (224; 534) to a height (D; d) of the at least one second insulation element (220; 320*a-d*; 420; 520; 620; 820) in the cross-section lies in the range of 1.2:1-3:1, further lie in the range of 1.3:1-2.5:1, and yet further lie in the range of 1.4:1-2.1:1.

8. Heat insulation structure (200; 300*a-d*; 400; 500) according to one of the preceding examples, wherein at least one first insulation element (210; 310*a-d*; 410; 510; 610; 810) and/or at least one second insulation element (220; 320*a-d*; 420; 520; 620; 820) comprise a filling material.

9. Heat insulation structure (200; 300*a-d*; 400; 500) according to the preceding example, wherein a ratio of a weight of filling material in the at least one second insulation element (220; 320*a-d*; 420; 520; 620; 820) to a weight of filling material in the at least one first insulation element (210; 310*a-d*; 410; 510; 610; 810) lies in the range of 1.3:1-4:1, further lies in the range of 1.4:1-3:1, and yet further lies in the range of 1.45:1-2.0:1.

10. Heat insulation structure (200; 300*a-d*; 400; 500) according to one of the preceding examples, wherein at least one first and at least one second insulation element (410; 420; 510; 520) each comprise:

an inner layer (414; 511; 521) and an outer layer (412; 512; 522) defining a cavity (515; 525), wherein a surface area of the inner layer (414; 511) of the at least one first insulation element (410; 510) is less than a surface area of the inner layer (414; 521) of the at least one second insulation element (420; 520).

11. Heat insulation structure (200; 300*a-d*; 400; 500) according to one of the preceding examples, wherein at least one first and at least one second insulation element (510; 520) each comprise:

an inner layer (511; 521) and an outer layer (512; 522) defining a cavity (515; 525), wherein a surface area of the inner layer (511) of the at least one first insulation element (510) is substantially of equal size as a surface area of the outer layer (512) of the at least first insulation element (510), and wherein a surface area of the inner layer (521) of the at least one second insulation element (520) is larger than a surface area of the outer layer (522) of the at least one second insulation element (520).

12. Heat insulation structure (200; 300*a-d*; 400; 500) according to one of the preceding examples 10 and 11, wherein the inner layer (414; 511) of the at least one first insulation element (410; 510) and the inner layer (414; 521) of the at least one second insulation element (420; 520) are jointly provided as an integral piece.

13. Heat insulation structure (200; 300*a-d*; 400; 500) according to one of the preceding examples 10-12, wherein the outer layer (412; 512) of the at least one first insulation element (410; 510) and the outer layer (412; 522) of the at least one second insulation element (420; 520) are jointly provided as an integral piece.

14. Heat insulation structure (200; 300*b-d*; 400; 500) according to one of the preceding examples, wherein at least one first insulation element (210; 310*b*; 310*d*; 410; 510; 610; 810) and/or at least one second insulation element (220; 320*c*; 320*d*; 420; 520; 620; 820) are elongated.

15. Heat insulation structure (200; 300*a-d*; 400; 500) according to one of the preceding examples, wherein at least one first insulation element (210; 310*a-d*; 410; 510; 810) and at least one second insulation element (220; 320*a-d*; 420; 520; 820) are arranged substantially horizontally when the garment is worn.

16. Heat insulation structure (200; 300*a-d*; 400; 500) according to one of the preceding examples, wherein at least one first insulation element (210; 310*a-d*; 410; 510; 610) and at least one second insulation element (220; 320*a-d*; 420; 520; 620) are arranged in a V-shape within the garment (600).

17. Heat insulation structure (200; 300*a-c*; 400; 500) according to one of the preceding examples, wherein at least one first insulation element (210; 310*a-c*; 410; 510; 610; 810) and at least one second insulation element (220; 320*a-c*; 420; 520; 620; 820) are alternatingly arranged alongside each other.

18. Heat insulation structure (200; 300*a-d*; 400; 500) according to one of the preceding examples, further comprising at least one cover layer (850), which is arranged on the inside and/or an outside of the heat insulation structure (200; 300*a-d*; 400; 500).

19. Garment (600; 800), in particular jacket (600; 800) or vest, with a heat insulation structure (200; 300*a-d*; 400; 500) according to one of the examples 1-18.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A heat insulation structure for a garment comprising:

at least one first insulation element comprising an inner layer and an outer layer defining a first uncompressed shape therebetween;

at least one second insulation element comprising an inner layer and an outer layer defining a second uncompressed shape therebetween that is different than the first uncompressed shape;

wherein the at least one first insulation element and the at least one second insulation element are connected at a respective connection area;

wherein the inner layer of the at least one first insulation element and the inner layer of the at least one second insulation element are jointly provided as a single piece;

wherein the outer layer of the at least one first insulation element and the outer layer of the at least one second insulation element are jointly provided as a single piece; and a contact area formed when the first uncompressed shape contacts the second uncompressed shape;

wherein the second uncompressed shape is configured to protrude toward a wearer's body;

wherein the heat insulation structure is incorporated into the garment; and wherein the second uncompressed shape is deformable through pressure applied by the wearer's body when the garment is worn, which increases a size of the contact area such that the at least one second insulation element at least partially overlaps the connection area when deformed, and wherein the increased contact area at least partially seals the connection area.

2. The heat insulation structure of claim 1, wherein the at least one first insulation element and the at least one second insulation element are three-dimensional enclosed structures filled with insulating material.

3. The heat insulation structure of claim 1, wherein the connection area is a respective seam, and the increased contact area is proximate to the seam such that the at least one second insulation element substantially overlaps the seam when it is deformed.

4. The heat insulation structure of claim 1, wherein the increased contact area reduces body heat loss.

5. The heat insulation structure of claim 1, wherein in a cross-section of the heat insulation structure, the at least one second insulation element comprises:

a first arc along an inner surface of the at least one second insulation element, the first arc comprising a first length; and a second arc along an outer surface of the at least one second insulation element, the second arc comprising a second length;

wherein the first length is longer than the second length.

6. The heat insulation structure of claim 5, wherein a ratio of the first length to the second length ranges between 1.2:1-3:1.

7. The heat insulation structure of claim 5, wherein a ratio of the first length to a height of the at least one second insulation element in the cross-section ranges between 1.2:1-3:1.

8. The heat insulation structure of claim 1, wherein at least one of (i) the at least one first insulation element and (ii) the at least one second insulation element comprise a filling material.

9. The heat insulation structure of claim 8, wherein a ratio of a weight of the filling material in the at least one second insulation element to a weight of the filling material in the at least one first insulation element ranges between 1.3:1-4:1.

10. The heat insulation structure of claim 1, wherein at least one of the at least one first insulation element and the at least one second insulation element is elongated.

11. The heat insulation structure of claim 1, wherein the at least one first insulation element and the at least one second insulation element are arranged substantially horizontally when the garment is worn.

12. The heat insulation structure of claim 1, wherein the at least one first insulation element and the at least one second insulation element are arranged in a V-shape within the garment.

13. The heat insulation structure of claim 1, wherein the at least one first insulation element and the at least one second insulation element are alternatingly arranged alongside each other.

14. The heat insulation structure of claim 1, further comprising at least one cover layer, which is arranged on an inside and/or an outside of the heat insulation structure.

15. A garment with a heat insulation structure of claim 1.

16. A heat insulation structure for a garment comprising:

a plurality of first insulation elements, each first insulation element comprising an inner layer and an outer layer defining a first uncompressed shape therebetween;

a plurality of second insulation elements, each second insulation element comprising an inner layer and an outer layer defining a second uncompressed shape therebetween that is different than the first uncompressed shape;

wherein the plurality of first insulation elements and the plurality of second insulation elements are connected at respective connection areas;

wherein the inner layer of each first insulation element and the inner layer of each second insulation element are jointly provided as single piece;

wherein the outer layer of each first insulation element and the outer layer of each second insulation element are jointly provided as a single piece; and a plurality of contact areas formed when each of the first uncompressed shapes contacts each of the second uncompressed shapes;

wherein the second uncompressed shape is configured to protrude toward a wearer's body;

wherein the heat insulation structure is incorporated into the garment; and wherein each of the second uncompressed shapes are deformable through pressure applied by the wearer's body when the garment is worn, which increases a size of each of the contact areas such that the plurality of second insulation elements at least partially overlap the connection areas when deformed, and wherein the increased contact areas at least partially seals the connection areas.

17. A heat insulation structure for a garment comprising at least one first insulation element;

at least one second insulation element wherein the at least one first insulation element and the at least one second insulation element are connected at a respective connection area; and a contact area formed when the at least one first insulation element contacts the at least one second insulation element;

wherein the at least one first insulation element and the at least one second insulation element each comprise an inner layer and an outer layer defining a cavity therebetween, wherein a surface area of the inner layer of the at least one first insulation element is less than a surface area of the inner layer of the at least one second insulation element;

wherein at least one of the inner layers of the first and second insulation elements and the outer layers of the first and second insulation elements are jointly provided as a single piece;

wherein the at least one second insulation element is configured to protrude toward a wearer's body;

wherein the heat insulation structure is incorporated into the garment; and wherein the at least one second insulation element is deformable through pressure applied by the wearer's body when the garment is worn, which increases a size of the contact area such that the at least one second insulation element at least partially overlaps the connection area when deformed, and wherein the increased contact area at least partially seals the connection area.

18. The heat insulation structure of claim 17, wherein the surface area of the inner layer of the at least one first insulation element is substantially of equal size as a surface area of the outer layer of the at least one first insulation element.

19. The heat insulation structure of claim 18, wherein the surface area of the inner layer of the at least one second insulation element is larger than a surface area of the outer layer of the at least one second insulation element.

20. The heat insulation structure of claim 17, wherein the inner layer of the at least one first insulation element and the inner layer of the at least one second insulation element are jointly provided as an integral piece.

21. The heat insulation structure of claim 17, wherein the outer layer of the at least one first insulation element and the outer layer of the at least one second insulation element are jointly provided as an integral piece.

* * * * *